US006702094B2

(12) United States Patent
Ishikawa et al.

(10) Patent No.: US 6,702,094 B2
(45) **Date of Patent: *Mar. 9, 2004**

(54) PASSENGER CONVEYOR DEVICE

(75) Inventors: Yoshinobu Ishikawa, Fuchu (JP); Megumi Ookubo, Fuchu (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/168,398

(22) PCT Filed: Oct. 22, 2001

(86) PCT No.: PCT/JP01/09249

§ 371 (c)(1),
(2), (4) Date: Jun. 21, 2002

(87) PCT Pub. No.: WO02/34660

PCT Pub. Date: May 2, 2002

(65) Prior Publication Data

US 2002/0179404 A1 Dec. 5, 2002

(30) Foreign Application Priority Data

Oct. 23, 2000 (JP) ..... 2000-322258

(51) Int. Cl.[7] ..... B65B 21/00
(52) U.S. Cl. ..... 198/330; 198/832.1; 198/326
(58) Field of Search ..... 198/321, 326, 198/330, 331, 832.1

(56) References Cited

U.S. PATENT DOCUMENTS

| | | | | | |
|---|---|---|---|---|---|
| 3,365,051 | A | * | 1/1968 | Mullis et al. | 198/330 |
| 3,677,388 | A | * | 7/1972 | Boltrek et al. | 198/330 |
| 4,232,783 | A | * | 11/1980 | Kraft | 198/851 |
| 4,535,880 | A | * | 8/1985 | Boltrek | 198/330 |
| 6,427,823 | B1 | * | 8/2002 | Ishikawa et al. | 198/330 |

FOREIGN PATENT DOCUMENTS

| | | |
|---|---|---|
| JP | 55-40185 | 3/1980 |
| JP | 55-115583 | 9/1980 |
| JP | 60-188289 | 9/1985 |
| JP | 63-20727 | 4/1988 |
| JP | 64-7957 | 1/1989 |
| JP | 10-132048 | 5/1998 |
| JP | 10-318343 | 12/1998 |
| WO | 00/63104 | 10/2000 |

* cited by examiner

*Primary Examiner*—Gene O. Crawford
(74) *Attorney, Agent, or Firm*—Oblon, Spivak, McClelland, Maier & Neustadt, P.C.

(57) ABSTRACT

An eccentric crankshaft is connected to a rotary driving device, and a rocking unit is connected to the eccentric crankshaft. Pin roller rolling gear teeth, each having a trochoid tooth-shape, are provided in the rocking unit. When the rocking unit rocks in accordance with eccentric rotation of the eccentric crankshaft, the trochoid shape of the pin roller rolling gear teeth meshes with pin rollers and thus gives a thrust to the pin rollers, thereby driving footsteps.

16 Claims, 15 Drawing Sheets

PASSENGER CONVEYOR DEVICE

TECHNICAL FIELD

The present invention relates to a passenger conveyer system such as an escalator, a moving walkway, or the like, in particular, to a passenger conveyer system for a long moving distance.

BACKGROUND ART

An escalator that is an example of the passenger conveyer system comprises a plurality of footsteps, each of which is provided with guide rollers in the front and the rear thereof. The plurality of footsteps is supported by engaging each of their guide rollers with a footstep guide rail provided in a structure. The footsteps move in a horizontal direction around the way in and the way out while keeping level, and move in an upward or a downward direction inclined at an angle of about thirty degrees on the way between the way in and the way out.

In general, the plurality of footsteps is connected to one another by means of a chain, and all the footsteps are moved continuously in synchronization with one another by driving the chain.

A driving unit that drives the chain employs a type of device that drives an end of the chain by means of a sprocket. The driving unit is provided around the way in or the way out. However, in regard to an escalator employing high footsteps, the load imposed on the chain is too large. Therefore, a sufficient driving force may not be transmitted by only driving the end of the chain in some cases. Such a problem is not limited to the escalator, but is a common one to passenger conveyer systems of long moving distances on the whole.

DISCLOSURE OF THE INVENTION

An object of the present invention is to provide a passenger conveyer system that is capable of applying sufficient driving force in the middle section of the chain and suitable for an escalator of high footsteps, a walkway of long moving distance, or the like.

To achieve the above object, a passenger conveyer system according to the invention comprises:

- a footstep guide rail provided in a structure;
- a plurality of footsteps which move along the footstep guide rail;
- a chain which connects the plurality of footsteps with one another in an endless circular manner; and
- a trochoid mechanism having a rocking unit, the mechanism including pin rollers which relatively drive linearly in accordance with the rock of the rocking unit and a trochoid tooth-shaped section which meshes with the pin rollers, the pin rollers and the trochoid tooth-shaped section disposed between the chain and the rocking unit.

In the passenger conveyer system according to the invention, the trochoid tooth-shaped section and the pin rollers move linearly at uniform velocity by one pitch of the pin rollers, and the footsteps can be moved forward accordingly through the chain. In such a mechanism, the mechanism, which drives by means of a chain, in itself has a function as a decelerator, which can combine two mechanism elements, such as a decelerator indispensable to a conventional driving mechanism and a chain driving transmission mechanism, into one driving mechanism.

BEST MODE FOR CARRYING OUT OF THE INVENTION

Embodiments of the present invention now will be described with reference to the accompanying drawings.

Figure 1:
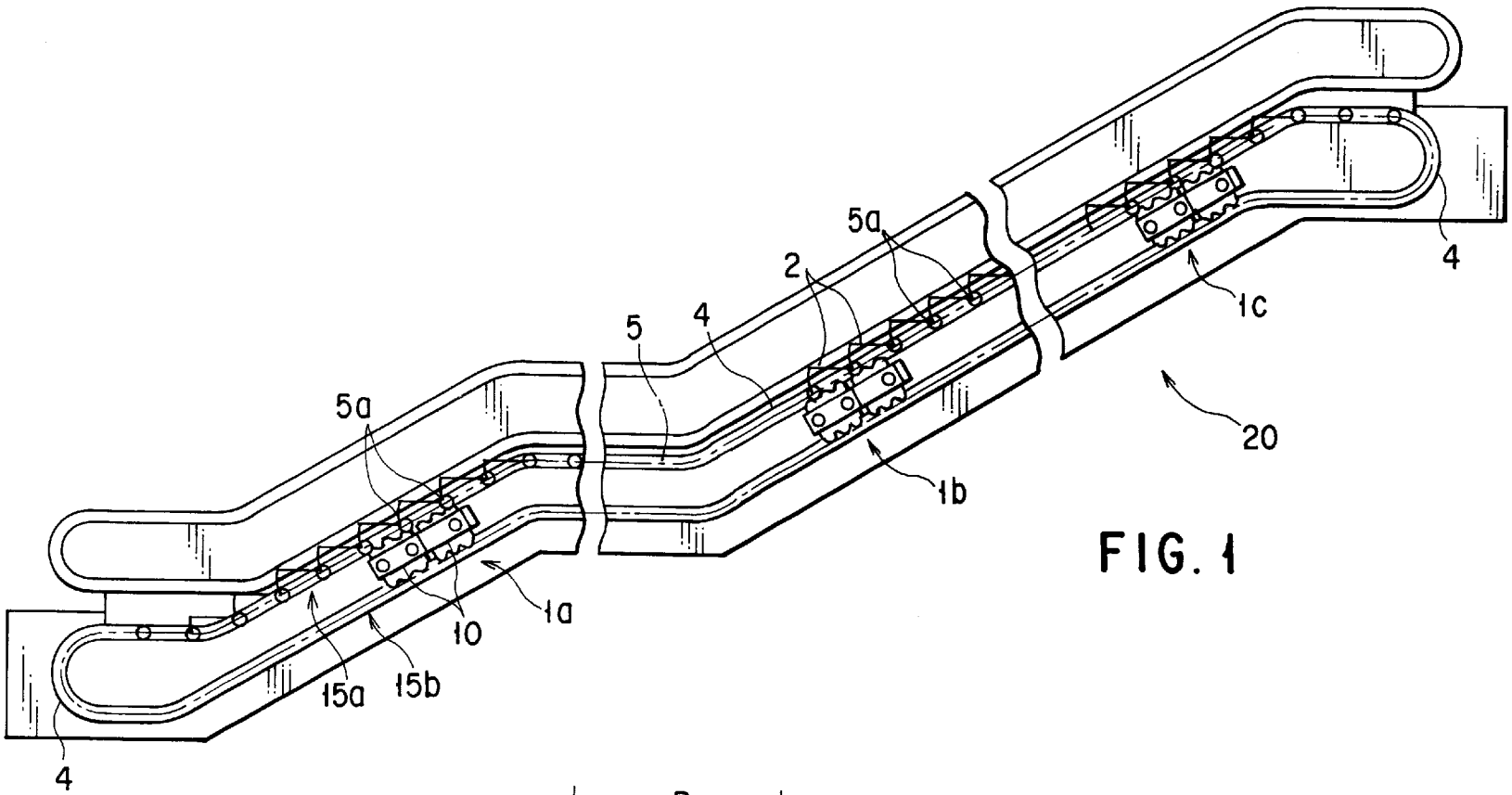
FIG. 1 is a diagram schematically showing the structure of a passenger conveyer system according to the first embodiment of the invention.

FIG. 1 is a diagram schematically showing the structure of a passenger conveyer system according to the first embodiment of the invention. As shown in FIG. 1, the passenger conveyer system 20 according to the first embodiment of the invention is constructed as an escalator. The passenger conveyer system 20 comprises a footstep guide rail 4 provided for a structure 120 in a circular way and a plurality of footsteps 2, which move along the footstep guide rail 4. The footstep guide rail 4 according to the present embodiment is constituted by a pair of parts, each of which has a C-shape section with its opening section faced toward the inside. (Refer to FIG. 3.)

Figure 2:
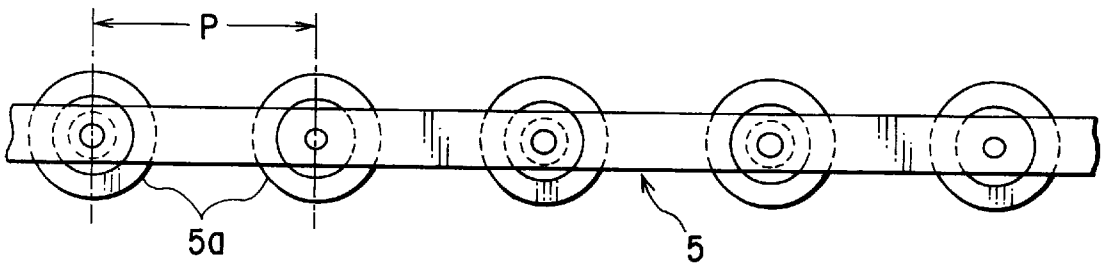
FIG. 2 is a diagram schematically showing the structure of a chain for the passenger conveyer system shown in FIG. 1.

The plurality of footsteps 2 are connected to one another by a pair of chains 5 (in the front side chain 5 and the rear side chain 5 from a plane view in FIG. 1) having pin rollers 5*a* on both sides in a direction right-angled to the longitudinal direction of the chains 5, i.e., a cross direction of the chains 5 and thus constructed annularly. As shown in FIG. 2, the pin rollers 5*a* are attached freely in rotating by a pitch P, i.e., at regular intervals to the chain 5. The pin rollers 5*a* constitute a trochoid mechanism together with a rocking plate 10 and pin roller rolling gear teeth 11.

The pin rollers 5*a* according to the embodiment engage with the footsteps guide rails 4, thereby guiding the footsteps 2 along the footsteps guide rail 4. That is, the pin rollers 5*a* also serve as guide rollers in the front section of the footsteps 2. However, guide rollers 50 in the rear section of the footsteps are formed larger in diameter than the pin rollers 5*a* and run on rear wheel guide rails 40 provided for the structure 120. (Refer to FIG. 3.)

Three driving mechanisms 1*a*, 1*b*, and 1*c* used for transmitting driving force to the chains 5 are arranged separately in the middle section of the footstep guide rails 4, more specifically, at a predetermined section other than end sections of the footstep guide rails 4, where the footstep guide rails 4 change their direction so as to turn up and down. The footstep guide rails 4 are partially eliminated in the sections where the driving mechanisms 1*a*, 1*b*, and 1*c* are disposed.

Figure 3:
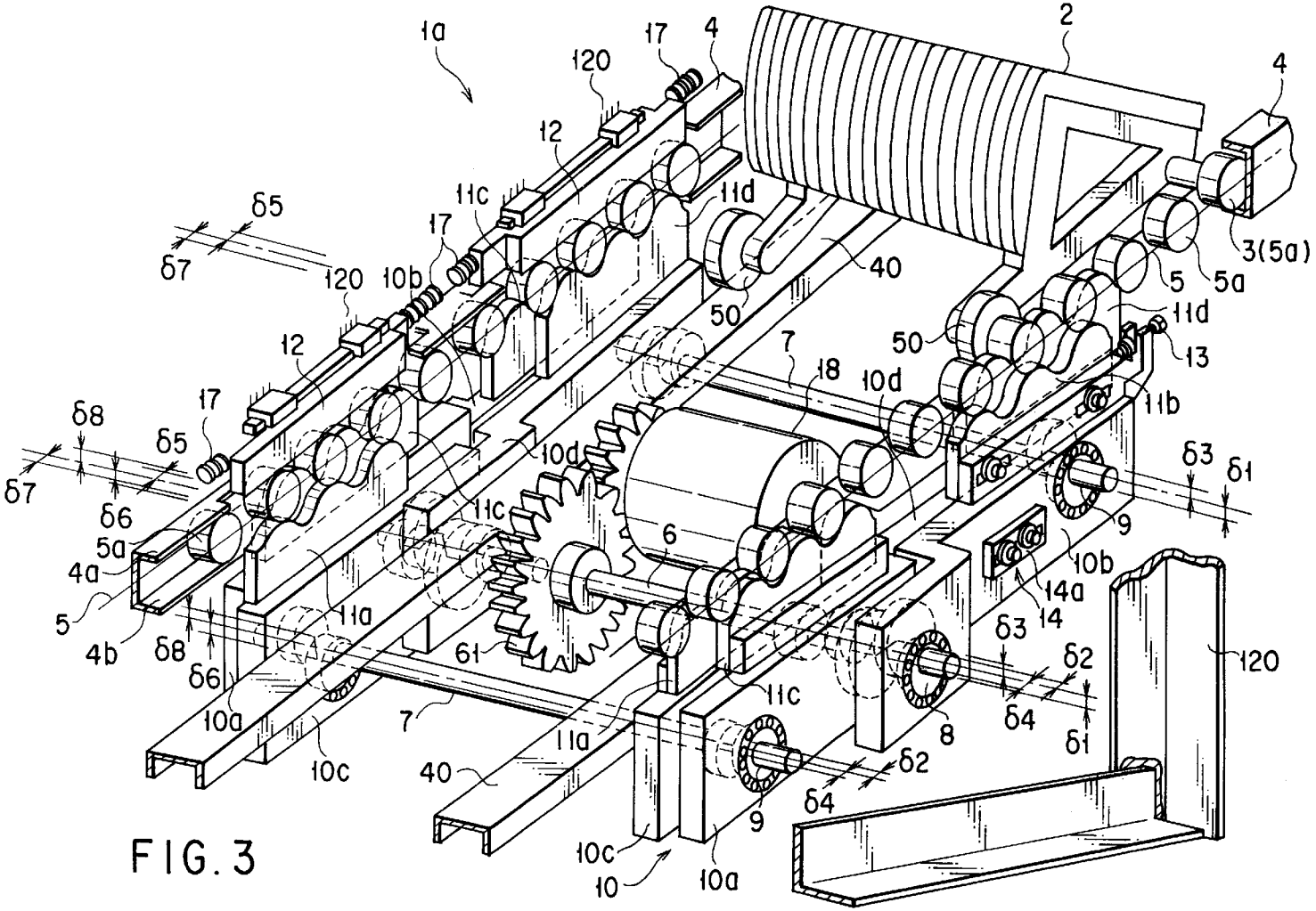
FIG. 3 is a schematic illustration showing the detail of a driving mechanism section for the passenger conveyer system shown in FIG. 1.

FIG. 3 is a detailed view of the driving mechanism 1*a*. The structures of the other driving mechanisms 1*b* and 1*c* are substantially the same as one of the driving mechanism 1*a* shown in FIG. 3. Therefore, the description will be given for only the driving mechanism 1*a* and omitted for the driving mechanisms 1*b* and 1*c*.

As shown in FIG. 3, the driving mechanism 1*a* has an electric motor 18 (rotary driving device) installed in the structure 120. The electric motor 18 is capable of generating driving force and suspension holding power. An eccentric crankshaft 6 is connected to the electric motor 18 through a reduction mechanism 61 constituted by gear teeth. To the eccentric crankshaft 6, eccentric discs 8 are connected with eccentricity δ (δ1 to δ8). So the eccentric discs 8 rotate eccentrically around the shaft center of the eccentric crankshaft 6 with eccentricity δ.

In the embodiment, in addition to the eccentric crankshaft 6, there are provided two idler eccentric crankshafts 7 to which eccentric discs 9 are attached. The eccentric discs 9 eccentrically rotate subordinately with the same eccentricity δ as one for the eccentric discs 8.

To each of the eccentric discs 8 of the eccentric crankshaft 6, four rocking plates 10 (10*a* to 10*d*) are connected serving as a rocking unit that rock in accordance with the eccentric rotation of the eccentric disc 8. The four rocking plates 10 are disposed such that the relevant rocking plates are divided in pairs and disposed in the front and the rear in an extended manner in a longitudinal direction, i.e., in a circular direction of the chain 5. The two rocking plates 10 disposed in a forward extended manner are connected to the eccentric disc 9 attached to one of the idler eccentric crankshaft 7. The two rocking plates 10 disposed in a backward extended manner are connected to the eccentric disc 9 of the other idler eccentric crankshaft 7. The respective rocking plates 10 are supported freely in rotating to the eccentric crankshaft 6 and the idler eccentric crankshafts 7.

In addition, the relative positioning relation between the four rocking plates 10 is arranged in that a phase shift of 90° is allotted equally for an eccentric angle between the four rocking plates. Further, in each of the four rocking plates 10, there is provided a mass balance adjustment device 14, which is capable of adjusting the weight and the fixing position of small additional weights 14*a*.

Trochoid-shaped pin roller rolling gear teeth 11 (11*a* to 11*d*) are attached detachably on the top and the bottom of the respective rocking plates 10. In FIG. 3, the structures at the bottom of the rocking plates 10 are omitted for simplifying the drawing. The pin roller rolling gear teeth 11*a* to 11*d* are disposed such that the relevant pin roller rolling gear teeth mesh sequentially with the pin rollers 5*a* of the chain 5 in accordance with the rock of the rocking plates 10*a* to 10*d*, thereby affording a thrust thereto. In the case of the embodiment, the pin roller rolling gear teeth 11 on the top and the of each rocking plate 10 mesh with both pin rollers 5*a* on an approach route side 15*a* and a return route side 15*b* (See FIG. 1) of the chains 5 that circulates back and forth, respectively, thereby affording a thrust thereto. The corners of each pin roller rolling gear teeth 11 are formed round so as to prevent concentrated stress from occurring.

In the case of this embodiment, in each rocking plate 10, there is provided a position fine adjustment function 13, which is capable of adjusting a mounting position, in which the pin roller rolling gear teeth 11 is mounted on the relevant rocking plate 10, in a circular direction of the chain 5. The position fine adjustment function 13 may be formed simply by, for example, a long hole and a bolt, etc.

In the structure 120 such as a truss structure, there are provided back guiding plates 12, which guide the pin rollers 5*a* on the reverse sides to the sides where the pin roller rolling gear teeth 11 are located with respect to the pin rollers 5*a* (the upper side in the approach route shown in the drawing, and the lower side in the return route not shown in the drawing). The back guiding plates 12 are disposed such that one back guiding plate corresponds to the rocking plates 10 that are disposed in pairs in the front and the rear in the circular direction of the chains 5.

The back guiding plates 12 are designed such that the back guiding plates can be translated in the circular direction of the chains 5 in accordance with the frictional force against the pin rollers 5*a*, which are in contact with, by the quantity of travel equal to or less than the eccentricity δ of the eccentric discs 8 against the eccentric crankshaft 6, while interposing the pin rollers 5*a* between the rocking plates 10 and themselves. For the back guiding plates 12, there are provided back guiding plate restoring devices 17, which restore the translated back guiding plates 12 to their original positions. The back guiding plates 12 are formed so hard as not to damage the pin rollers 5*a* and can be replaced.

Figure 4:
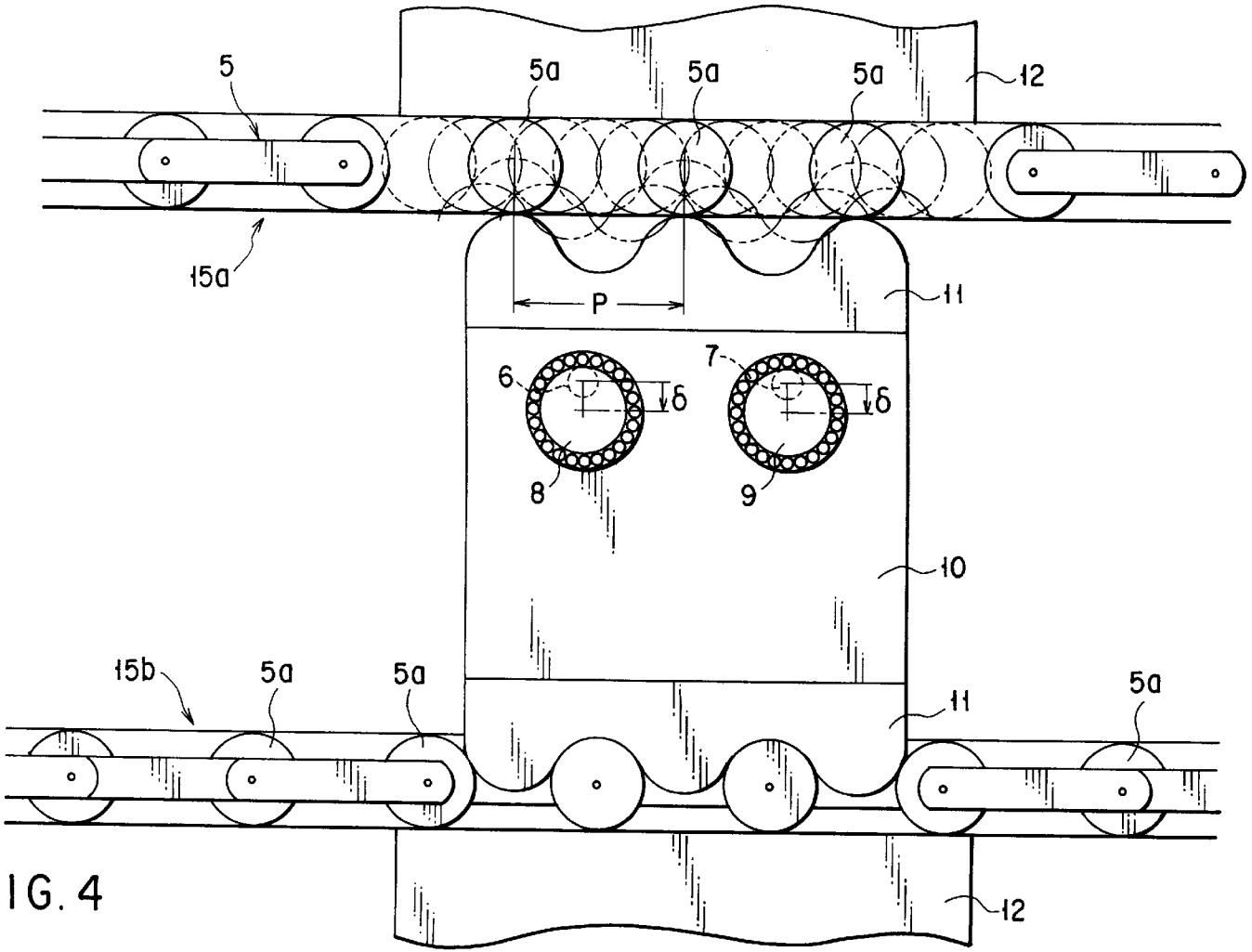
FIG. 4 is a diagram for explaining the principle of operation concerning pin roller rolling gear teeth and pin rollers.

Next, the action according to the embodiment constructed as the above will be described with reference to FIG. 4. FIG. 4 is a diagram for explaining the principle of movement concerning the rocking plate 10, the trochoid-shaped pin roller rolling gear teeth 11 and the pin rollers 5*a*, these constituting the trochoid mechanism.

The pin rollers 5*a* of the chain 5 are attached by the pitch P at regular intervals, as described above. The back guiding plates 12 support the back faces of the pin rollers 5*a* from the reverse sides to the pin roller rolling gear teeth 11.

In this state, the electric motor 18 is driven so that the eccentric disc 8 is rotated eccentrically working with the rotations of the toothed gear 61 and the eccentric crankshaft 6, as shown in FIG. 4. Then, the eccentric disc 9 of the idler eccentric crankshaft 7 is subordinately rotated eccentrically with the same eccentricity δ as one of the eccentric disc 8.

Accordingly the rocking plate 10 rocks while keeping parallel to the circular direction of the chain 5. By this rocking movement, the trochoid-shaped pin roller rolling gear teeth 11 (11*a* to 11*d*) mesh sequentially with the pin rollers 5*a*, and thus the four rocking plates 10 (10*a* to 10*d*) transmit a thrust continuously to the pin rollers 5*a*. Accordingly, the pin rollers 5*a* move forward at uniform velocity, without unevenness in velocity. In this case, with one rotation of the eccentric crankshaft 6, the pin rollers 5*a* proceed by one pitch P.

When the rocking plates 10 rock continuously, the pin roller rolling gear teeth 11 give a thrust to the chain 5 through the pin rollers 5*a*. Accordingly, two chains 5 are driven and then the footsteps 2 are moved. Incidentally, it is possible to use an inexpensive geared motor with a one-stage toothed gear as the electric motor 6. In this case, the reduction mechanism 61 for the electric motor 6 can be omitted.

On transmitting the thrust to the pin rollers 5*a*, the pin roller rolling gear teeth 11 also gives a force to the pin rollers 5*a* in a direction other than the moving direction (circular direction of the chains 5). However, since the guide rails 4 are formed from members having a C-shape in section, the pin rollers 5*a*, i.e., the footsteps 2 move smoothly. In addition, if the pin roller rolling gear teeth 11 are mounted detachably on the rocking plates 10, only pin roller rolling gear teeth 11 need be detached from the rocking plates 10 for replacement. That enables mass production of only the pin roller rolling gears 11. As a result, maintenance expenses can be reduced. Obviously, the pin roller rolling gear teeth 11 can be formed integrated with the rocking plate 10.

In addition, it is possible to amend an error in mounting the pin roller rolling gear teeth 11 in each of the separately disposed driving mechanisms 1*a*, 1*b*, and 1*c* with use of the position fine adjustment function 13 shown in FIG. 3.

Further, the pin roller rolling gear teeth 11 according to the embodiment are arranged pairs separately in the front and the rear in the circular direction of the chain 5, and the pair of the pin roller rolling gear teeth 11 presses the pin rollers 5*a* of limited width L. Therefore, a treatment of rounding the corners, or the like can be sufficiently applied to the pin roller rolling gear teeth 11 in comparison with the case where the four pin roller rolling gear teeth 11 are formed further thinner and made into one unit. Accordingly, it is possible to relieve generation of the concentrated stress caused by edge portions. In addition, the thickness of the pin roller rolling gear teeth 11 is secured. Therefore, the strength of the pin roller rolling gear teeth 11 can also be secured. As a result, durability and reliability of the pin roller rolling gear teeth 11 can be improved.

Additionally, an angle of 90° is allotted equally as the phase shift of the eccentric angle for each of the four rocking plates 10*a* to 10*d*. Therefore, the whirling force between the rocking plates 10*a* to 10*d* is canceled so that the generation of vibration can be relieved. In the case where the vibration occurs, the weight and mounting position of the small additional weight 14*a* is changed in the mass balance adjustment device 14 shown in FIG. 3. Then, it is possible to adjust the mass balance easily. Accordingly, mechanical damage such as a fatigue failure caused by vibration can be suppressed.

Incidentally, according to the embodiment, the pin roller rolling gear teeth 11 are provided on both the top and the bottom of the rocking plate 10. Therefore, the pin roller rolling gear teeth 11 can give thrusts to the pin rollers 5*a* on both the approach route side 15*a* and the return route side 15*b* of the chain 5 that circulates back and forth. Thus, excellent driving force transmission efficiency can be obtained. In this case, the pin roller rolling gear teeth 11 only needs to be provided on one side of the rocking plate 10.

The back guiding plate 12 is formed from a material having a hardness to wear out prior to the pin rollers 5*a*, thereby not damaging the pin rollers 5*a*. Thus the frequency of replacing the chains 5 is reduced. In addition, independent parts constitute the exhausted back guiding plates 12 so that they can be replaced easily with new ones.

Further, while the pin roller rolling gear teeth 11 of the rocking plates 10 are pressing the pin rollers 5*a*, the back guiding plates 12 on the back of the pin rollers 5*a* are translated together with the pin rollers 5*a* without any slip. When the pin roller rolling gear teeth 11 of the rocking plates 10 leave from the pin rollers 5*a*, the back guiding plates 12 return to the original positions by the pressure supplied by the back guiding plate restoring devices 17. Therefore, in the back guiding plates 12, abrasion caused by rock can be prevented from occurring and further, durability and reliability are improved.

Incidentally, the passenger conveyer system 20 according to the embodiment is constructed as an escalator. However, it can be also constructed for a level moving walkway.

Figure 5:
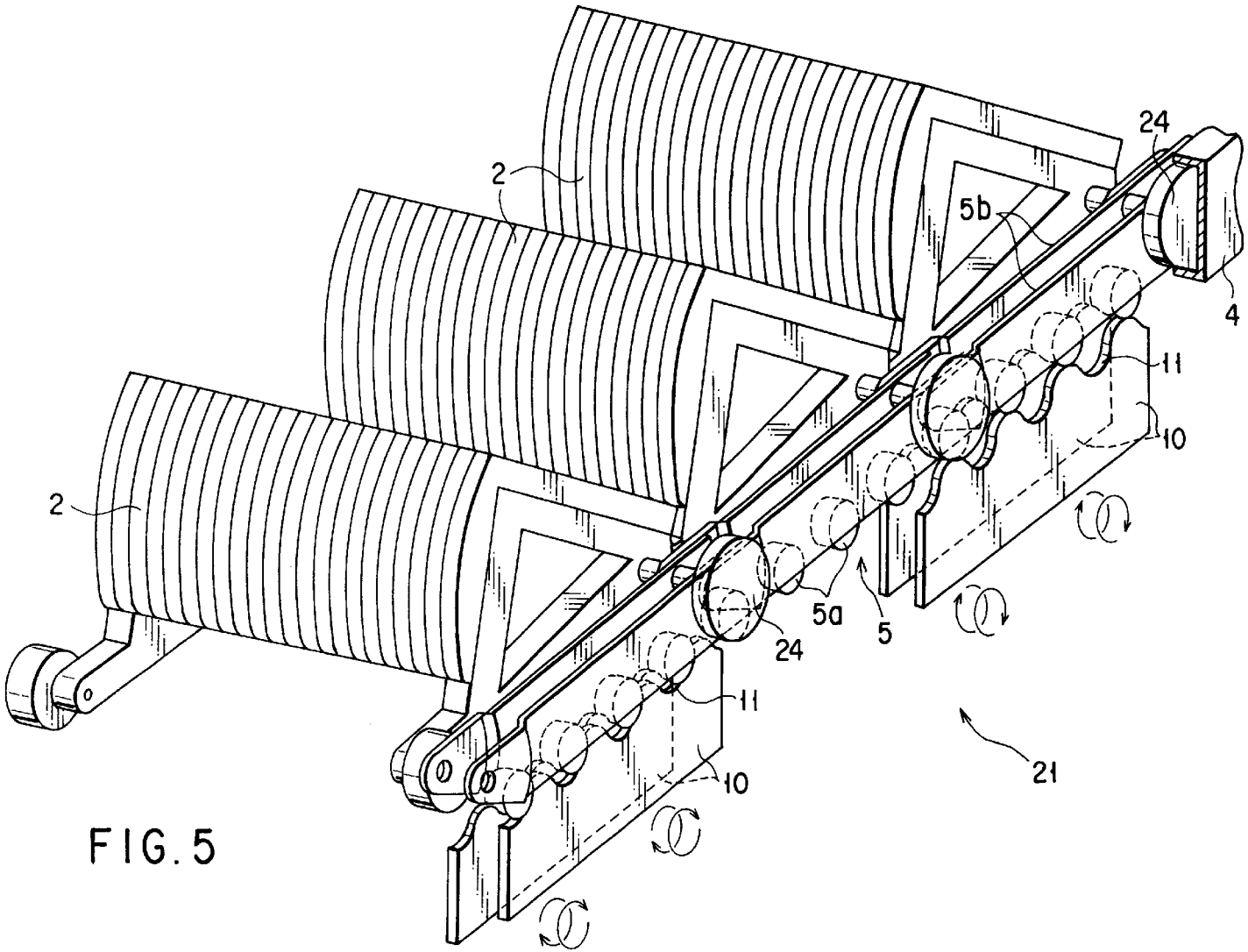
FIG. 5 is a schematic illustration showing the detail of a driving mechanism section for a passenger conveyer system according to the second embodiment of the invention.

Next, the passenger conveyer system according to the second embodiment of the invention will be described with reference to FIG. 5. FIG. 5 is a schematic illustration showing a driving mechanism 21 for the passenger conveyer system according to second embodiment of the invention.

As shown in FIG. 5, in the passenger conveyer system 20 according to the present embodiment, the chain 5 is constructed by connecting a number of paired links 5*b*, each having the length of one pitch of the footstep 2. At the front end of each link 5*b*, a guide roller 24 is provided separately from the pin rollers 5*a*. Four of the pin rollers 5*a* are attached between the respective paired links 5*b* with the relation of layout in which the pin rollers 5*a* are allotted equally when the links 5*b* are arranged in a straight line.

The footstep guide rail 4 is engaged with only the guide rollers 24. The pin rollers 5*a* of the chain 5 do not engage with the footstep guide rail 4. The footstep guide rail 4 has a C-shape in section and the guide rollers 24 roll on the inside thereof. Therefore, movement of the guide rollers 24 in a vertical direction can be controlled. As a result, the footstep guide rail 4 functions as a back guiding plate that guides the pin rollers 5*a* of the chain 5 on the reverse side to the side where the pin roller rolling gear teeth 11 are located.

The other structures are substantially the same as ones according to the first embodiment shown in FIGS. 1 to 3. In the second embodiment, the identical sections to the first embodiment shown in FIGS. 1 to 3 are marked with the identical symbols, and detailed descriptions will be omitted.

According to the present embodiment, since the link 5*b* of the chain 5 has a length equal to one pitch of the footstep 2, the number of links can be reduced, at the same time, the number of portions where the pin rollers 5*a* mesh with the pin roller rolling gear teeth 11 can be increased easily by increasing the number of the pin rollers 5*a*. Therefore, the velocity reducing ratio (reduction ratio) using a trochoid tooth form can be improved easily.

Figure 6:
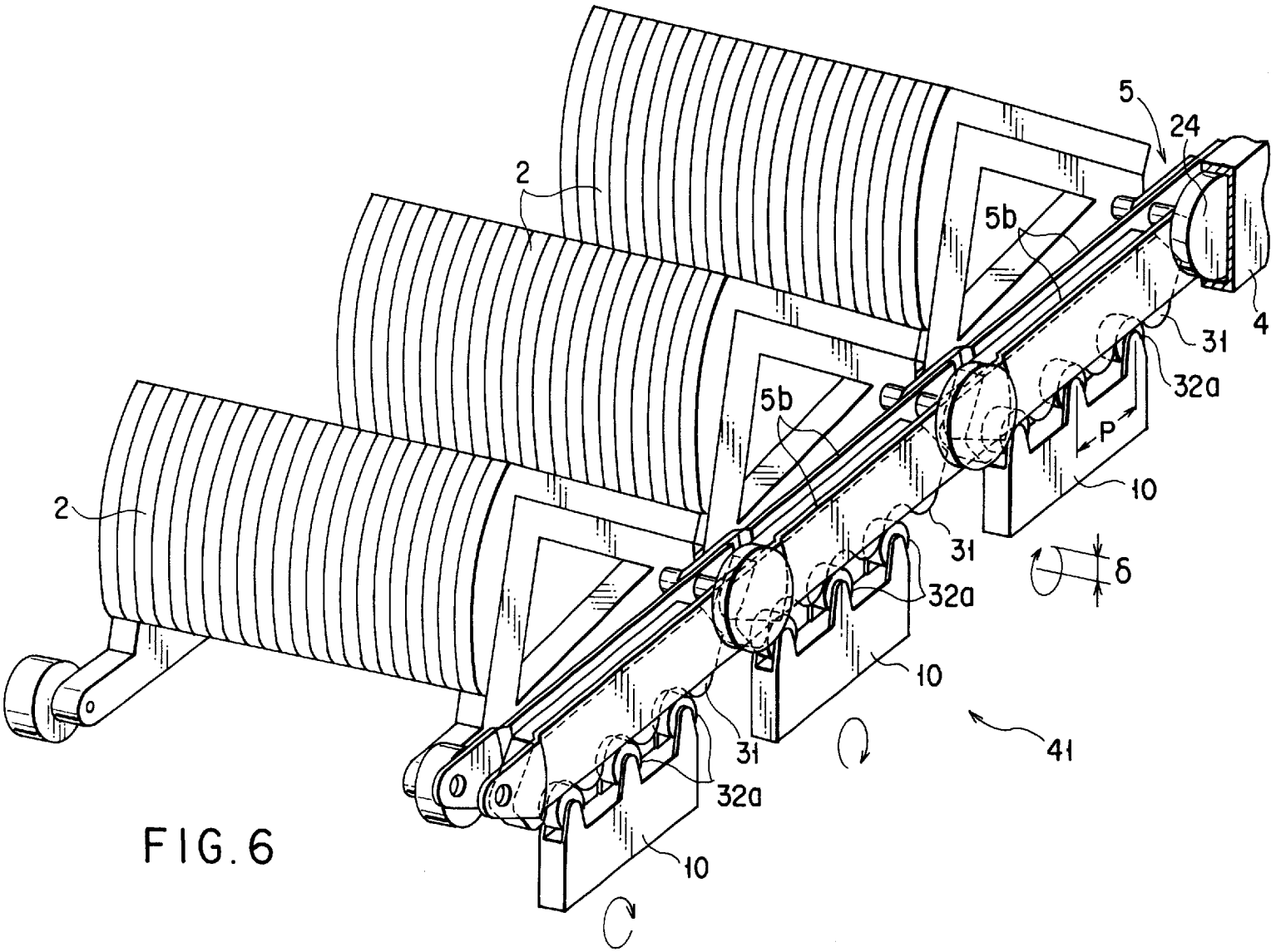
FIG. 6 is a schematic illustration showing the detail of a driving mechanism section for a passenger conveyer system according to the third embodiment of the invention.

Next, the passenger conveyer system according to the third embodiment of the invention will be described with reference to FIG. 6. FIG. 6 is a schematic illustration showing a driving mechanism 41 for the passenger conveyer system according to third embodiment.

As shown in FIG. 6, in a passenger conveyer system 30 according to the embodiment, pin roller rolling gear teeth 31 of the trochoid tooth form are formed in the links 5*b* of the chain 5. At the top and bottom ends of the rocking plates 10, there are provided eccentric rocking pin rollers 32*a* that give thrusts to the pin roller rolling gear teeth 31 in accordance with the rocking of the rocking plates 10.

The other structures are the substantially the same as ones according to the second embodiment shown in FIG. 5. In the third embodiment, the identical sections to the second embodiment shown in FIG. 5 are marked with the identical symbols, and detailed descriptions will be omitted.

According to the present embodiment, the difference from the second embodiment is only that the pin rollers 32*a* and the pin roller rolling gear teeth 31 are mounted in the reverse manner, and the passenger conveyer system in this embodiment acts in the substantially same manner as the one in the second embodiment.

Next, with respect to the driving mechanism common to the passenger conveyer systems according to the first, second, and third embodiments described above, the allocation of eccentric phase angles of the respective rocking plates 10*a* to 10*d* connected to the eccentric crankshaft 6 and the arrangement of the pin roller rolling gear teeth 11*a* to 11*d* will be described in further detail. The basis constituting components of the driving mechanism are common to ones of the driving mechanism 1*a* shown in FIG. 3, and thus these components will be described with identical symbols to FIG. 3.

Figure 7:
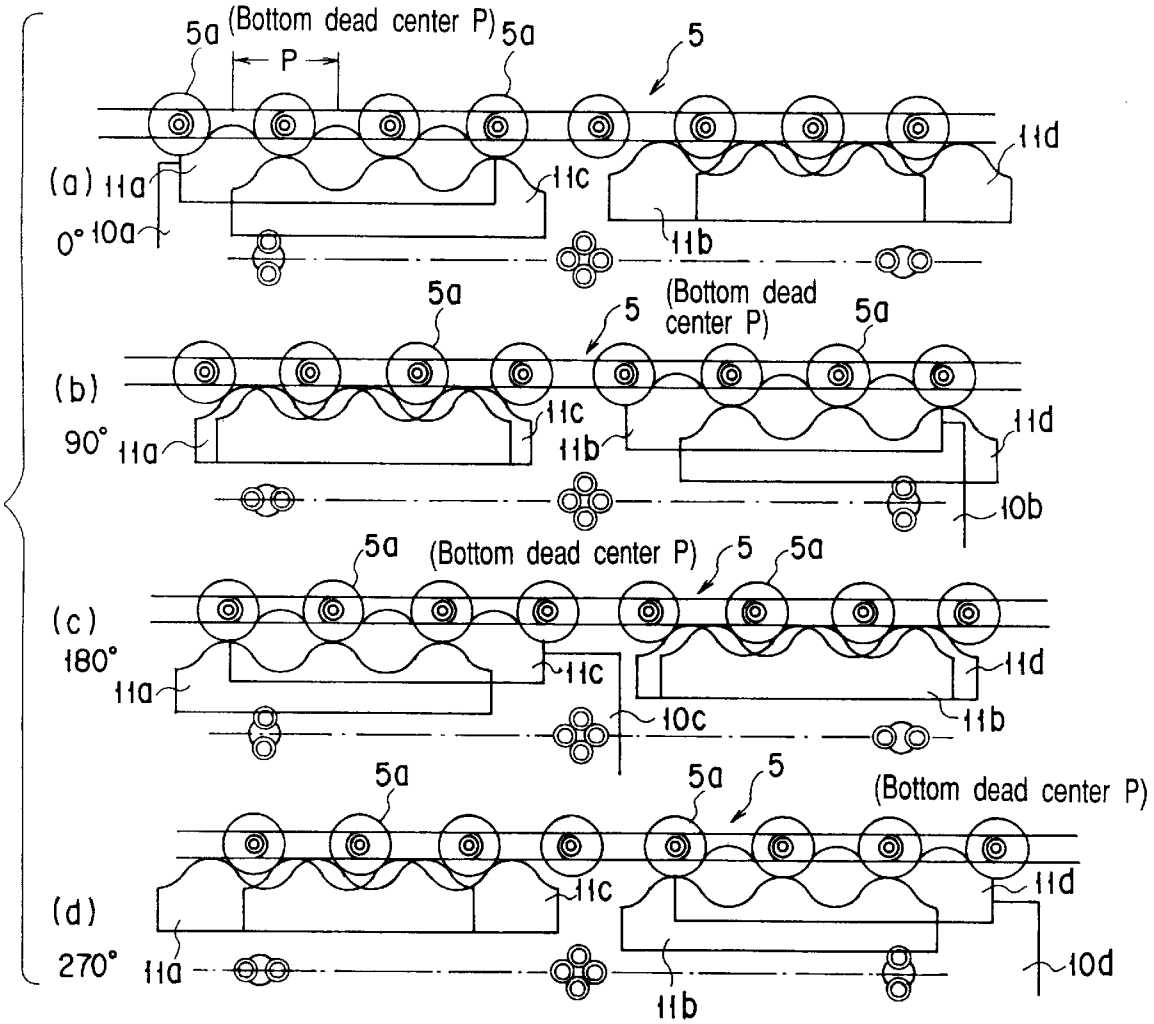
FIG. 7 is a diagram for explanation, showing positions of each pin roller rolling gear teeth during one rotation of an eccentric crankshaft.

FIG. 7 is a diagram showing changes of the meshing position of the pin rollers 5*a* during one rotation of the crankshaft 6, against the pin roller rolling gear teeth 11*a* to 11*d*, which are mounted on the rocking plates 10*a* to 10*d*, respectively, disposed as shown in FIG. 3.

Each of the pin roller rolling gear teeth 11*a* to 11*d* has the identically shaped trochoid tooth form. That aims to reduce the production cost for the complicated trochoid tooth form. However, in order to engage the pin roller rolling gear teeth 11*a* to 11*d* with the pin rollers 5*a* and move the chain 5 smoothly by the distance equal to the pitch P of the pin roller rolling gear teeth during one rotation of the eccentric crankshaft 6, it is designed that the phases of the trochoid tooth forms are not overlapped with one another and thus the meshing positions of the pin roller rolling gear teeth with the pin rollers 5*a* are changed.

More specifically, the eccentric phase angles of the rocking plates 10*a*, 10*b*, 10*c*, and 10*d* are shifted mutually by 90°. Assuming the difference of each eccentric phase angle of the rocking plates 10*b*, 10*c*, and 10*d* against the rocking plate 10*a* as reference to be $\Delta\Phi i$, each phase of the trochoid tooth forms in the pin roller rolling gears teeth 11*a* to 11*d* that are mounted on the rocking plates 10*a*, 10*b*, 10*c* and 10*d* are shifted by $\Delta p = P \times \Delta\Phi i/360$ toward the proceeding direction of the chain 5 in regard to the relative positioning relation against the pin rollers 5*a*. (P denotes the pitch of the trochoid tooth form. In this case, P is equal to the pitch of the chain 5.)

If the above is described specifically in accordance with FIG. 7, that will be described as follows. FIG. 7(*a*) shows the respective positions of the pin roller rolling gear teeth 11*a* to 11*d* when the rotation angle of the eccentric crankshaft 6 is at 0° or 360°. Assume that the pin roller rolling gear teeth 11*a* is used as reference. In this case, the phase of the trochoid tooth form of the pin roller rolling gear teeth 11*b* having the difference of the eccentric phase angle of 90° from the reference is shifted by P×¼ (P×90/360) toward the proceeding direction of the chain against the trochoid tooth form of the pin roller rolling gear teeth 11*a*, as far as the relative position to the pin rollers 5*a* is concerned. In the same manner, in regard to the relation between the pin roller rolling gear teeth 11*b* and the pin roller rolling gear teeth 11*c*, the difference of the eccentric phase angle is 90°. Therefore, the phase shift of the trochoid tooth form concerning the relative position to the pin rollers 5*a* is P×½ (P×180/360). In regard to the pin roller rolling gear teeth 11*d*, the phase shift is P×¾ (P×270/360).

Such relative phase shifts between the trochoid tooth forms and the pin rollers 5*a* are not changed in the cases where the rotation angle of the eccentric crankshaft 6 is at 90° (FIG. 7(*b*)), 180° (FIG. 7(*c*)), or 270° (FIG. 7(*d*)). Therefore, during one rotation of the eccentric crankshaft 6, the respective pin roller rolling gear teeth 11*a* to 11*d* can smoothly move the chain 5 by the pitch P at uniform velocity while continuously changing their meshing positions to the pin rollers 5*a* in accordance with the rock of the rocking plates 10*a* to 10*d*.

In the driving mechanism constructed as the above, since the respective units, i.e., the unit of the rocking plates 10*a* and 10*c*, and the unit of the rocking plates 10*b* and 10*d*, are disposed separately in the front and the rear, inertial force in the rocking movement is canceled mutually. Therefore, the inertial force does not act as excitation force to the eccentric crankshaft 6 and the idler eccentric crankshafts 8. As a result, it is possible to restrain vibration or noise from occurring.

The above description relates to the phase shift in the proceeding direction of the chain in the trochoid tooth forms of the pin roller rolling gear teeth 11*a* to 11*d*. In order to add the appropriate thrust to the pin rollers 5*a* with the rock of the pin roller rolling gear teeth 11*a* to 11*d*, it is necessary that the pin rollers 5*a* are guided appropriately by the footstep guide rails 4 or the back guiding plates 12, and the pin roller rolling gear teeth 11*a* to 11*d* do not interfere with the footstep guide rails 4 or the back guiding plates 12. For this reason, the footstep guide rails 4 and the back guiding plates 12 now will be described in detail with reference to FIG. 8.

Figure 8:
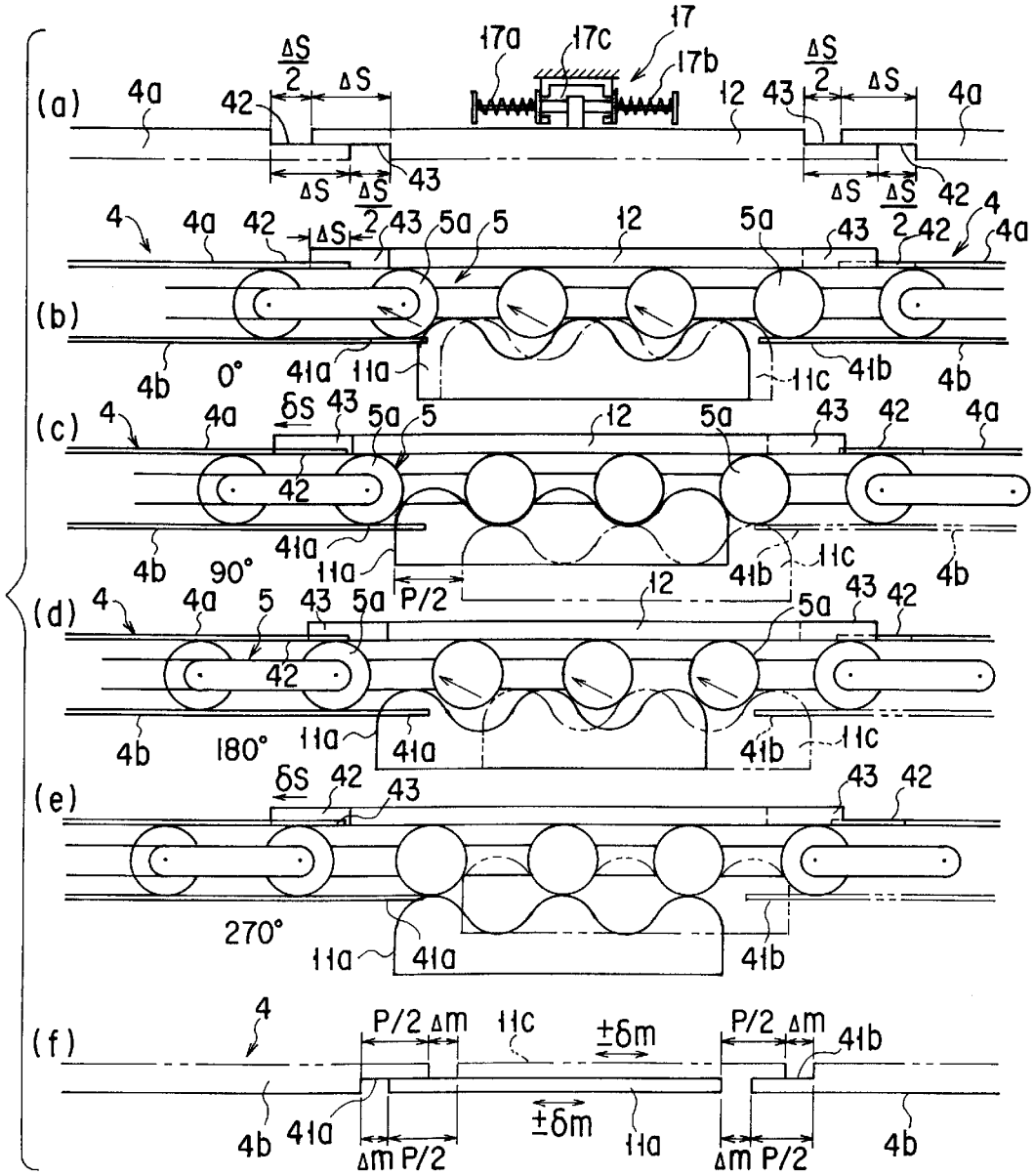
FIG. 8 is a diagram for explanation, showing the movement of each pin roller rolling gear teeth during one rotation of an eccentric crankshaft and a positional relation between a footstep guide rail and a back supporting plate.

FIG. 8 is a diagram for explaining a positioning relation between the footstep guide rail 4 and the back guiding plate 12 in regard to the unit of the pin roller rolling gear teeth 11*a* and 11*c* among the pin roller rolling gear teeth 11*a* to 11*d*.

As shown in FIG. 3, the footstep guide rail 4 is a guide rail of hook-shape in section, whose upper guide section 4*a* and lower guide section 4*b* are used as rolling guide ways for the pin rollers 5*a*.

FIG. 8(*a*) is a plan view of the upper guide section 4*a* with the footstep guide rail 4 viewed from above, and FIGS. 8(*b*) to 8(*e*) show the movement of the pin roller rolling gear teeth 11*a* and 11*c* when the eccentric crankshaft 6 is rotated 90° by 90°. FIG. 8(*f*) is a plan view showing the lower guide section 4*b* of the footstep guide rail 4. Incidentally, the unit of the pin roller rolling gear teeth 11*b* and 11*d* is similar to the unit of the pin roller rolling gear teeth 11*a* and 11*c*, and is thus omitted in FIG. 8.

In the footstep guide rail 4, a disconnect section is provided so as not to locate precisely over the pin roller rolling gear teeth 11*a* and 11*c*. The pin roller rolling gear teeth 11*a* and 11*c* pass through the disconnect section of the footstep guide rail 4 and rock toward the top dead center and the bottom dead center. As shown in FIG. 8(*f*), the pin roller rolling gear teeth 11*a* and 11*c* rock parallel to the footstep guide rail 4. When the pin roller rolling gear teeth 11*a* is located in the top dead center or the bottom dead center, the phase difference exists by only P/2 in a longitudinal direction against the pin roller rolling gear 11*c*. (P denotes the pitch of the trochoid tooth form.) (Refer to FIG. 8(*c*) or FIG. 8(*e*).)

For the purpose of preventing the footstep guide rail 4 from interfering with the pin roller rolling gear teeth 11*a* and 11*c* which rock with such phase difference, a stepped shape is formed in the lower guide section 4*b* of the footstep guide rail 4 such that relief sections 41*a* and 41*c* are formed at ends of the lower guide section, the ends opposing each other with the pin roller rolling gear teeth 11*a* and 11*c* interposed therebetween. The relief sections are formed by rectangularly notching parts of the respective ends of the lower guide section in an interlocked manner. It is preferable that the width of the respective relief sections 41*a* and 41*c* is half as much as the width of the lower guide section 4*b* and its length is at least P/2. In addition, as shown in FIG. 8(*c*) and 8(*e*), in the case where the pin roller rolling gear teeth 11*a* and 11*c* are located in the top dead center and the bottom dead center, respectively, it is set that the pin roller rolling gear teeth 11*a* and 11*c* overlap with the lower guide section 4*b* with 0.28 P in length to the maximum extent while leaving clearance of Δm in the relief sections 41*a* and 41*c*.

Assuming the quantity of movement for the pin roller rolling gear teeth 11*a* and 11*c* in the proceeding direction of the chain 5 to be ±δm, the δm can be ±0.159P to the maximum extent in proceeding from FIG. 8(*b*) to FIG. 8(*d*) in the relation to the pitch P. Accordingly, while the pin roller rolling gear teeth 11*a* and 11*c* are rocking, the clearance Δm is assured. Therefore, the lower guide section 4*b* does not interfere with the pin roller rolling gear teeth 11*a* and 11*c*, and further sections in which the lower guide section 4*b* overlaps with the pin roller rolling gear teeth 11*a* and 11*c* are assuredly secured. As a result, although there are disconnect sections in the footstep guide rail 4, the pin rollers 5*a* of the chain 5 move smoothly without interruption from one end to the other end of the lower guide section 4*b* while riding on the pin roller rolling gear teeth 11*a* and 11*c*.

On the other hand, as shown in FIG. 8(*a*), in the upper guide 4*a* of the footstep guide rail 4 in addition to the above case, relief sections 42, each having a predetermined length of ΔS, are formed at both end portions opposed to each other with the back guiding plate 12 interposed therebetween by rectangularly notching parts of the respective ends. In the case of the upper guide 4*a*, rectangular relief sections 43 are also formed at the both end portions of the back guiding plate 12 in the same manner. The back guiding plate 12 is connected to the back guiding device 17 that returns the back guiding plate to the neutral position shown in FIGS. 8(*b*) and 8(*d*). The back guiding device 17 has a function of holding the position of a rod 17*c* by means of springs 17*a* and 17*b* having the elastic modulus equal to each other. While dragged by the pin rollers 5*a* that move by the rock of the pin roller rolling gear teeth 11*a* and 11*c*, the back guiding plate 12 is translated. In this case, the back guiding plate 12 can be returned to the original neutral position by the elasticity of the springs 17*a* and 17*b*.

More specifically, when the trochoid tooth forms of the pin roller rolling gear teeth 11*a* and 11*c* move so as to extrude the pin rollers 5*a* in such a process shown from the FIG. 8(*b*) to FIG. 8(*c*) or a process shown from FIG. 8(*d*) to FIG. 8(*e*), the back guiding plate 12 is dragged by the movement of the pin rollers 5*a* and thus moves in a translated manner by the quantity of travel δs. By this translated movement, the spring 17*a* of the back guiding plate restoring device 17 is compressed, and the spring 17*b* is pulled and stretched.

On the other hand, when the trochoid tooth forms of the pin roller rolling gears 11*a* and 11*c* simply roll and guide the pin rollers 5*a* in such a process shown from the FIG. 8(*c*) to FIG. 8(*d*) or a process shown from FIG. 8(*e*) to FIG. 8(*b*), the back guiding plate 12 does not receive a drag from the pin rollers. Therefore, the spring 17*a* of the back guiding plate restoring device 17 presses back the back guiding plate 12, and the spring 17*b* pulls back the relevant plate. As a result, the back guiding plate 12 can return to the neutral position.

In addition, by setting the sizes of the relief sections 42 and 43 as follows, the upper guide section 4*a* of the footstep guide rail 4 and the back guiding plate 12 can overlap mutually in an interlocked manner without interfering with each other.

Assume that the length of the respective relief sections 42 and 43 is ΔS in the jointing section where the upper guide section 4*a* and the back guiding plate 12 overlap each other. And, assume that the width of the section, where the back guiding plate 12 located in the neutral position shown in FIG. 8(*b*) or 8(*d*) and the upper guide section 4*a* overlap with each other, is Δs. And further assume that the quantity of translated movement of the back guiding plate 12, which is dragged by the pin rollers 5*a* moved by the rock of the pin roller rocking gear teeth 11*a* and 11*c* and thus moved in a translated manner together with the relevant rollers, is δs. Then, ΔS−Δs is set larger than the quantity of translated movement δs. By setting as the above, as shown in FIG. 8(*c*), even when the back guiding plate 12 moves by δs from the natural position, a clearance is assured in the relief sections 42 and 43. Therefore, the relief sections 42 and 43 can be prevented from interfering with each other and maintain the smooth movement.

Next, the passenger conveyer system according to the fourth embodiment will be described with reference to FIGS. 9 and 10.

Figure 9:
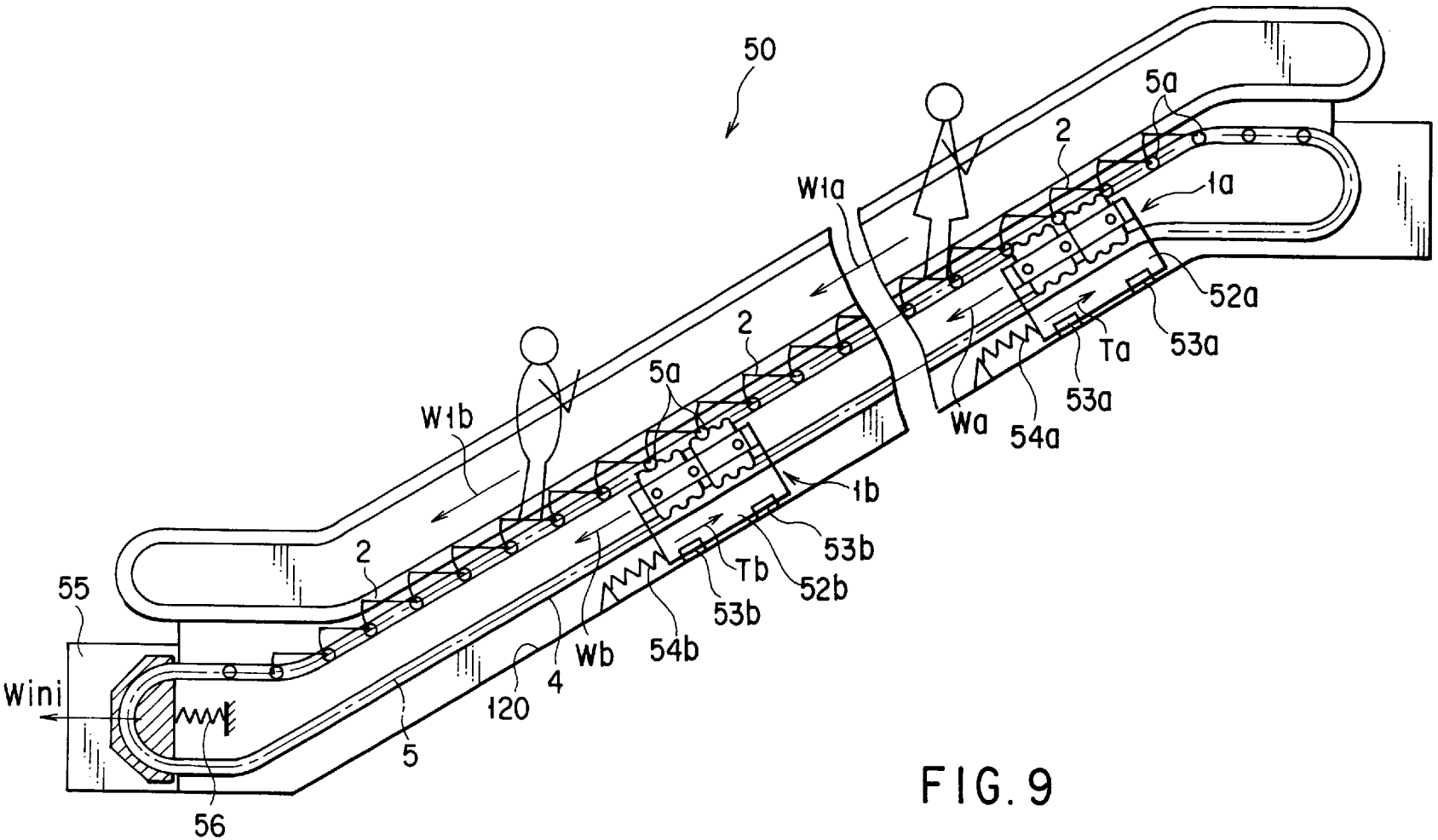
FIG. 9 is a diagram schematically showing the structure of a passenger conveyer system according to the fourth embodiment of the invention.

FIG. 9 is a diagram schematically showing the structure of the passenger conveyer system according to the fourth embodiment of the invention. In the conveyer system 50 according to the fourth embodiment, the footstep guide rail 4 provided for the structure 120 and the plurality of footsteps 2 that move along the footstep guide rail 4 are the same as ones in the third embodiment described above. In addition, the plurality of footsteps 2 are connected circularly by a pair (in the front and the rear side from a plane view in FIG. 7) of the chains 5 having the pin rollers 5*a* in the same manner as one in the passenger conveyer system according to the first to third embodiments. And the driving mechanisms 1*a* and 1*b*, which drive the chains 5, are disposed separately at a predetermined interval in the middle section of the footstep guide rail 4. The base structure of the respective driving mechanisms 1*a* and 1*b* is one common to the driving mechanism shown in FIG. 3. Thus the identical constituting components are marked with the identical symbols, and detailed descriptions will be omitted.

The passenger conveyer system according to the fourth embodiment is constructed as an escalator that has gaps at its way in and the way out located on both ends of the structure. Housings 52*a* and 52*b* of the driving mechanisms 1*a* and 1*b* are arranged to the structure 120, which inclines with the same inclination as the footstep guide rail 4, through supporting sections 53*a* and 53*b* in a manner slidable in a moving direction of the footsteps 4.

The constant force is applied to the whole of the driving mechanisms 1*a* and 1*b*, which are arranged in a slidable manner, from the structure 120 side so that chain tension energization means 54*a* and 54*b*, which increase tension of the chains 5, are provided. In addition, at a lower turning section 55 of upper and lower reversal sections in the footsteps 2, initial tension adding means 56 used for adding initial tension to the chains 5 is disposed. These chain tension energization means 54*a* and 54*b*, and the initial tension adding means 56 are configured to energize tension of the chains 5 with use of elastic power of springs or the like and to eliminate looseness in a case where the initial slack occurs in the chains 5.

Figure 10:
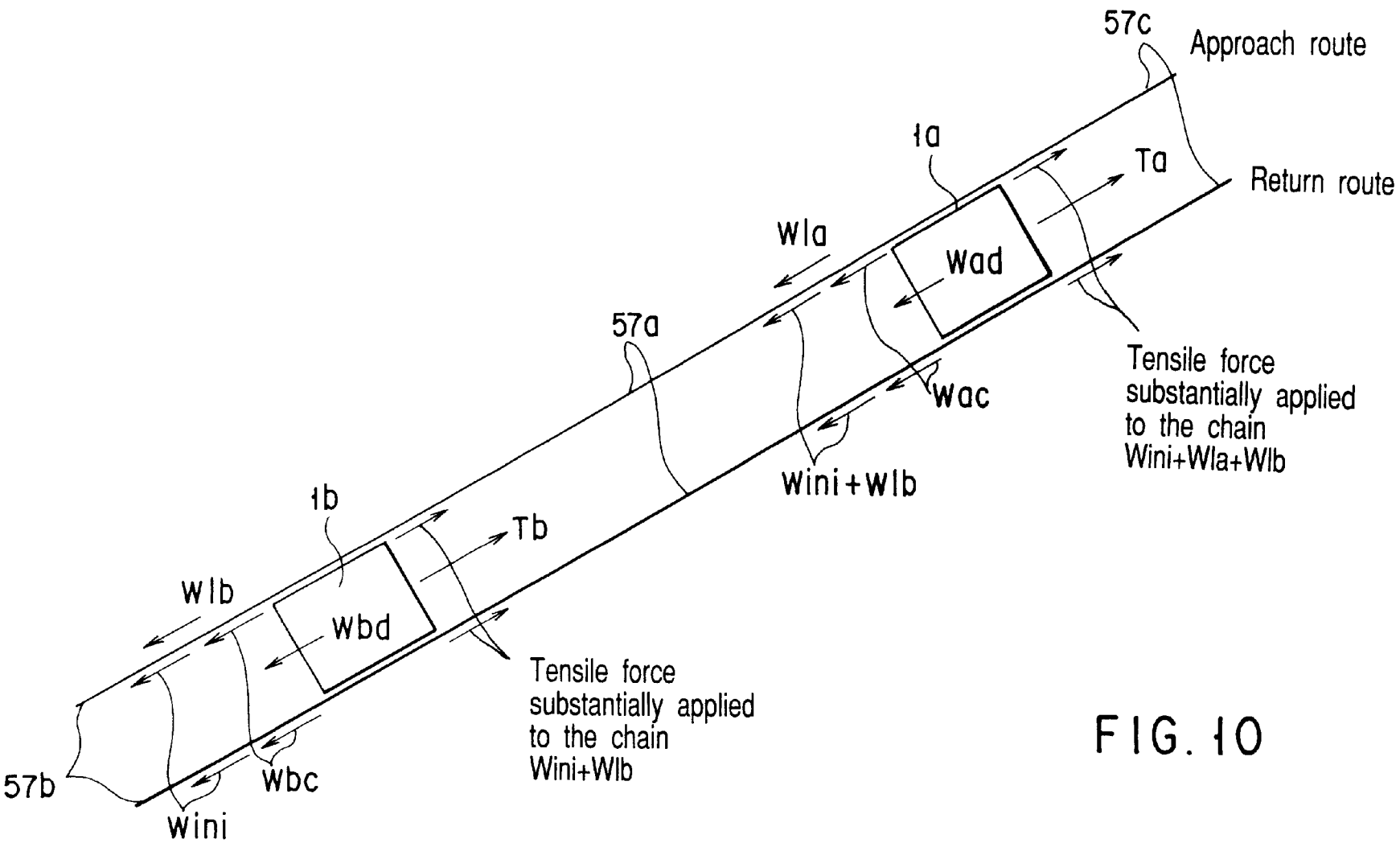
FIG. 10 is a diagram for explaining the balance of force applied to a chain in the passenger conveyer system shown in FIG. 9.

FIG. 10 is a diagram showing a state of balance between forces, which affects the chains 5, in the form of a model. In FIG. 10, as a matter of convenience for description, the reference symbol 57*b* denotes chains between the lower turning section and the lower driving mechanism 1*b*, and the 57*a* denotes the sections of the chains upper than the driving mechanism 1*b*.

In FIG. 10, at first, the balance between forces in regard to the lower driving mechanism 1*b* will be considered. The reference symbol Wbc denotes an inclination angle element of the weight of the chains 57*b*; the Wbd, an inclination angle element of the weight of the driving mechanism 1*b* itself; the Wini, initial tension to be applied from the initial tension adding means 56 to the chains 57*b*; and the W1*b*, an inclination angle element of the weight of passengers and loads, which affects the area between the lower turning section 55 and the driving mechanism 1*b*. (The W1*b* fluctuates depending on state of operation. Therefore, the W1*b* will be referred to as fluctuating load weight, hereinafter.) These forces act downwards, in parallel to the chains 57*b*.

Assume that Tb denotes the force that energizes the chains 57*b* upwardly and in parallel through the chain tension energization means 54*b* while the lower driving mechanism 1*b* drives the chains 57*b*. Since this chain energization force Tb acts continuously, the tension of the chains 5 can be controlled as follows.

That is, the degree of the chain energization force Tb is set substantially equal to the inclination angle element Wbc of the weight of the chains 57*b* and to the angle inclination element Wbd of the weight of the driving mechanism 1*b*. By doing this, it is possible to sustain the weight corresponding to the sum Wb of the inclination angle element Wbc of the weight of the chains 57*b* and the angle inclination element Wbd of the weight of the driving mechanism 1*b* through the chain tension energization means 54*b*. (Since the sum Wb is fixed for each conveyer system, the relevant sum Wb will be referred to as fixed load weight, hereinafter.) As a result, no fixed load weight Wb is applied to the chains 57*a*, which is located on the upper side than the driving mechanism 1*b*. The tension acting on the chains 57*a* is substantially reduced to Wini+W1*b*, which is the sum of the initial tension Wini that is applied from the initial tension adding means 56 and the aforementioned fluctuating load weight W1*b*.

Further, in the case of the balance between the forces in regard to the upper driving mechanism 1*a* as well, the degree of the chain energization force Ta supplied from the chain tension energization means 54*a* is set substantially equal to the sum Wa of the inclination angle element Wac of the weight of the chains 57*a* and the angle inclination element Wad of the weight of the driving mechanism 1*a* itself. (Since the sum Wa is fixed for each conveyer system, the relevant sum Wba will be referred to as fixed load weight, hereinafter.) By doing this, it is possible to sustain the fixed load weight Wa, which is the sum of the inclination angle element Wac of the weight of the chains 57*a* and the angle inclination element Wad of the weight of the driving mechanism 1*a*, through the chain tension energization means 54*a*. Therefore, no fixed load weight Wa is applied to the chains 57*c*, which is located on the upper side than the driving mechanism 1*a*. As a result, the substantial effective tension can be reduced to the sum of Wini+W1*b*, which is brought above by the chains 57*a*, and the fluctuating load weight W1*a*, which is the inclination angle element of the summed weight of passengers and loads between the driving mechanism 1*b* and the driving mechanism 1*a*, that is Wini+W1*a*+W1*b*.

In short, on all of the chains 5, the fixed load weight Wa and Wb is borne through the chain tension energization means 54*a* and 54*b*, respectively, so that the load on the chains 5 can be reduced by the borne weight. Incidentally, the fluctuating load weight W1*a* and W1*b* are zero in the case of no load existing. Therefore, at least the initial tension Wini affects all of the chains 5.

Figure 11:
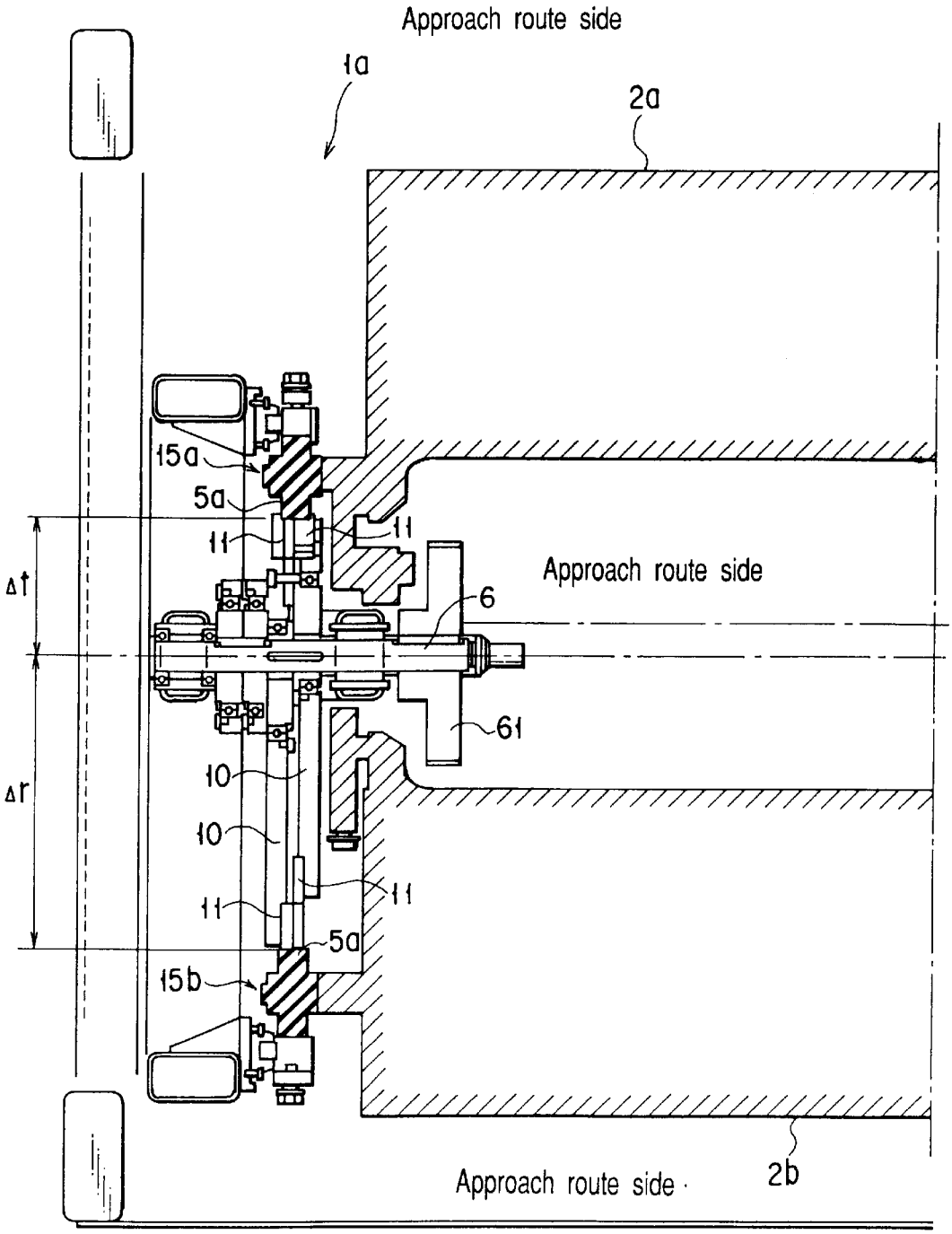
FIG. 11 is a cross-sectional view of the driving mechanism shown in FIG. 9.

The above description is the embodiment in which the chain tension energization means 54*a* and 54*b* are provided additionally to the driving mechanisms 1*a* and 1*b* so as to reduce the load on the chains 5. Next, FIG. 11 shows the driving mechanisms 1*a* and 1*b* in which the fluctuating load weight W1*a* and W1*b* are sustained through pin roller rolling gears. In this case, both the driving mechanisms 1*a* and 1*b* have the same structure and thus only the driving mechanism 1*a* will be described with reference to FIG. 8. Incidentally, in FIG. 11, the identical reference symbols to FIG. 3 denote the same constituting components.

In FIG. 11, the Δt shows the distance between the axis of the eccentric crankshaft 6 and a chain 15*a* on the approach route side. And the Δr shows the distance between the axis of the eccentric crankshaft 6 and a chain 15*b* on the return route side. In this case, the Δt and the Δr are different from each other, and the distance Δr toward the return route side is longer.

A unit of pin roller rolling gear teeth 11 having the same trochoid form, two making one unit, is allocated on both the approach route side and the return route side in each rocking plate 10. Each of the pin roller rolling gears 11 is attached to the rocking plate 10 so as to maintain mesh with the pin rollers 5*a*. In this manner, in the driving mechanism in which the rocking movement of the rocking plates 10 is converted into a thrust for chains through the pin roller rolling gears, each gears having the trochoid forms, the relative position of an eccentric crankshaft 8 against the chain 15*a* on the approach route side and the chain 15*b* on the return route side can be set freely. Therefore, there is flexibility in designing, in particular, the size of the driving mechanism in its height direction can be easily reduced.

The inclination angle elements of the fixed load weight and the fluctuating load weight, both weights affecting the chain 15*b* on the return route side, can be sustained through the pin roller rolling gear teeth 11 on the approach route side. On the other hand, the inclination angle elements of the fixed load weight and the fluctuating load weight, both weights affecting the chain 15*a* on the approach route side, can be sustained through the pin roller rolling gear teeth 11 on the return route side. Thus, the entire weight of the chains 15*a* and 15*b* can be shared sustained by the pin roller rolling gears 11 on both the approach route side and the return route side. As a result, the load on the chains 15*a* and 15*b* can be reduced.

Next, the passenger conveyer system according to the fifth embodiment will be described with reference to FIG. 12.

Figure 12:
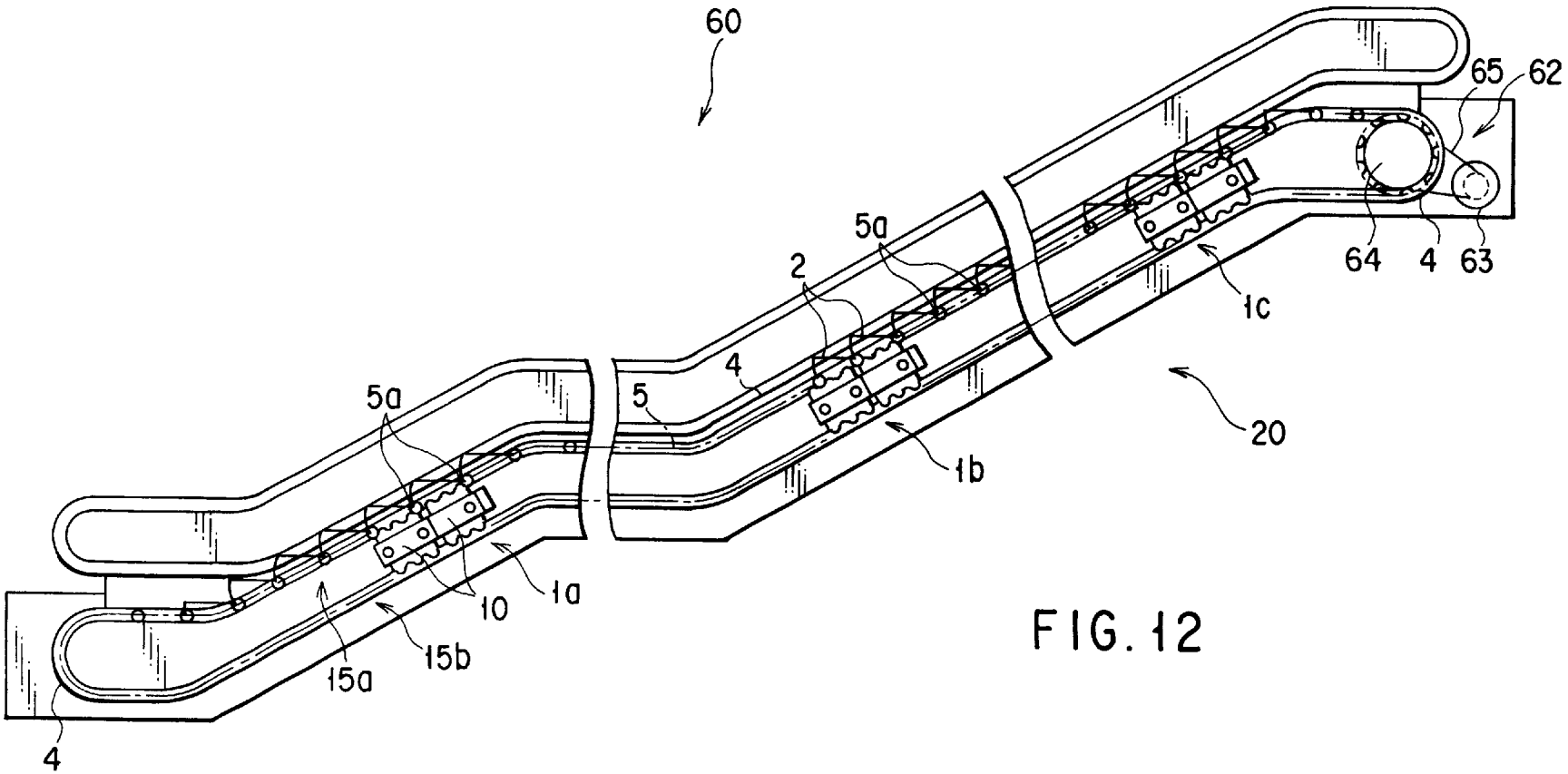
FIG. 12 is a diagram schematically showing the structure of a passenger conveyer system according to the fifth embodiment of the invention.

FIG. 12 is a diagram schematically showing a structure of the passenger conveyer system 60 according to the fifth embodiment. Similarly to the passenger conveyer system shown in FIG. 1, the relevant passenger conveyer system is constructed as a distributed driving system in which the driving mechanisms 1*a* to 1*c* are distributed at predetermined intervals along the chain 5. The structures of the respective distributed driving mechanisms 1*a* to 1*c* are the same as one of the driving mechanism shown in FIG. 3, and thus the description for the structures will be omitted.

The different point in the passenger conveyer system 60 according to the fifth embodiment from ones according to the above-described embodiments is that a driving mechanism 62, which drives turning reverse section for the chains 5 on the upper story, is disposed under the way in and the way out located on the upper story, separately from the distributed driving mechanisms 1*a* to 1*c*.

The driving mechanism 62 drives the chain 5 in cooperation with the distributed driving mechanisms 1*a* to 1*c*. Therefore, the driving mechanism 62 may only generate the driving force sufficient to convey the weight equivalent to the inclination angle element of the summed weight of passengers and loads between the distributed driving mechanism 1*c* located uppermost and the driving mechanism 62 (equivalent to the aforementioned fluctuating load weight). A driving motor 63 of small capacity can cope with the relevant driving force sufficiently. On the other hand, in regard to the driving force necessary for the distributed driving mechanisms 1*a* to 1*c*, the following driving forces are sufficient: the driving force sufficient to convey the fluctuating load weight between the turning reverse section for the chain 5 on the lower story and the distributed driving mechanism 1*a* for the distributed driving mechanism 1*a* located lowest; the driving force sufficient to convey the fluctuating load weight between the distributed driving mechanisms 1*a* and 1*b* for the middle distributed driving mechanism 1*a*; and the driving force sufficient to convey the fluctuating load weight between the distributed driving mechanisms 1*b* and 1*c* for the upper distributed driving mechanism 1*c*. Accordingly, a driving motor of large capacity is not necessary for the one in each of the distributed driving mechanisms 1*a* to 1*c*. Therefore, owing to the cooperation with the inexpensive driving mechanism 62 to a certain extent, on the whole, the production cost for the passenger conveyer system according to the embodiment can be reduced.

Next, the passenger conveyer system according to the sixth embodiment of the invention will be described with reference to FIGS. 13, 14A and 14B.

Figure 13:
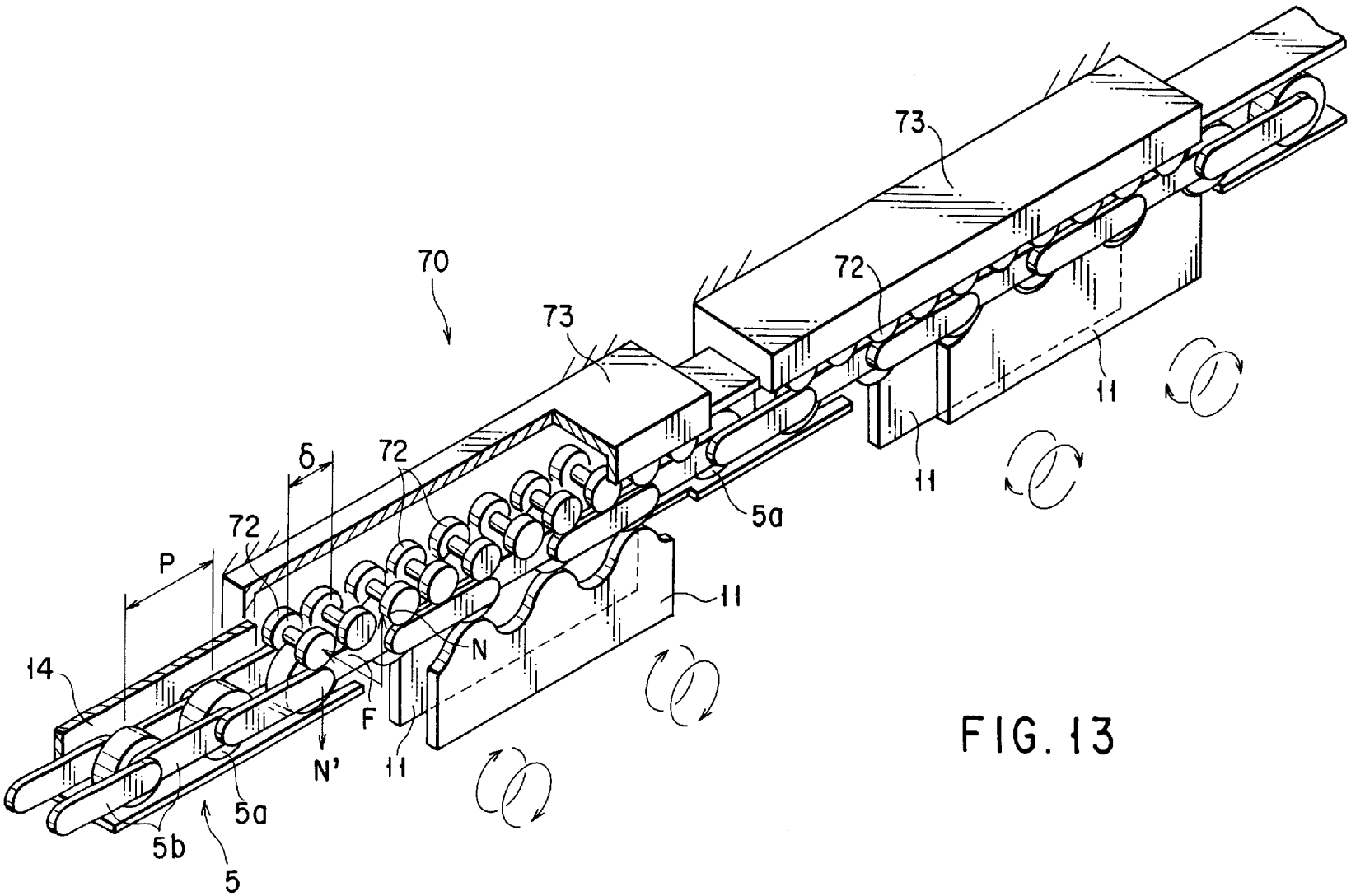
FIG. 13 is a perspective view showing the structure of back supporting rollers which back and support a chain in a passenger conveyer system according to the sixth embodiment of the invention.

FIG. 13 is a perspective view showing a main part of a driving mechanism 70 of the passenger conveyer system according to the sixth embodiment. The links 5*b* constituting the chain 5 connect the pin rollers 5*a* sequentially with pitch length P. The structure and the positioning relation of the pin roller rolling gear teeth 11 are the same as ones according to the above-described embodiments.

The sixth embodiment is characterized in that a back supporting roller mechanisms including a plurality of back supporting rollers 72, which rolls the links 5*b* of the chain 5, is provided at the position over the pin roller rolling gear teeth 11. The back supporting rollers 72 in the relevant mechanism are arranged in a roller housing 73 of elongated housing shape, whose lower end is open, at predetermined intervals in a longitudinal direction of the chain 5. In this case, it is desired that the back supporting rollers 72 are arranged such that their intervals δ are set as short as possible in comparison with the pitch length P of the chain 5, preferably, set equal to or less than P/2.

Figure 14A:
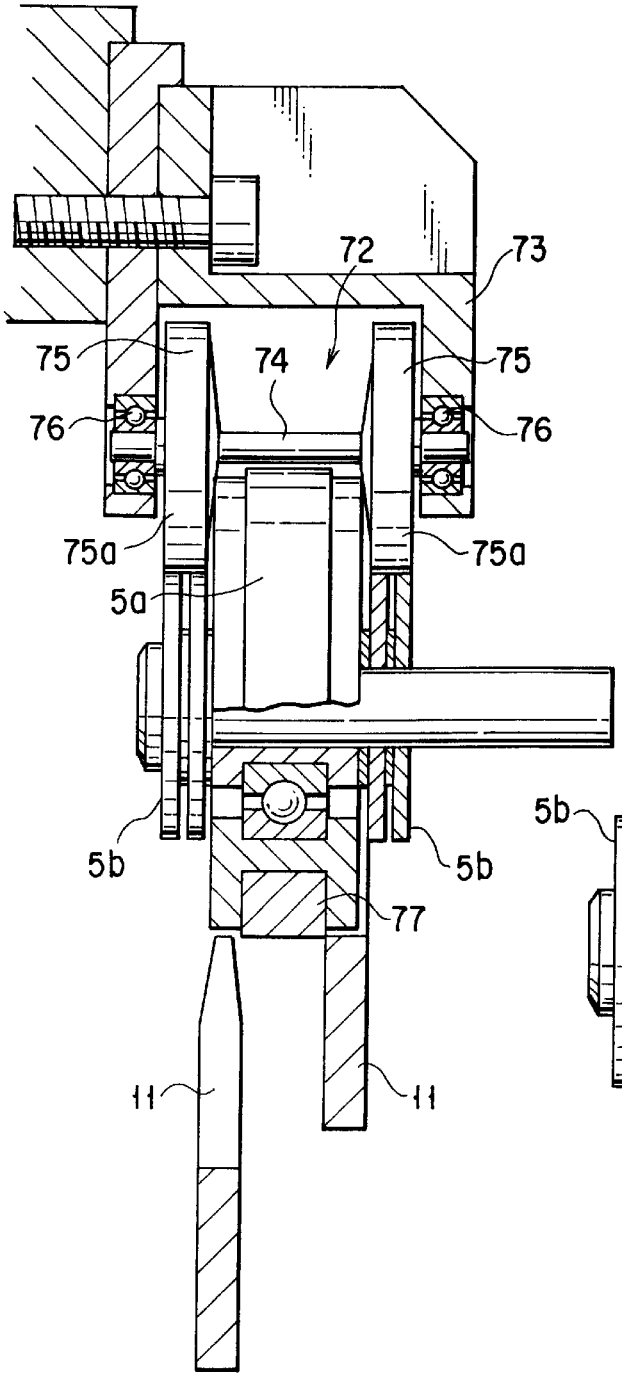
FIGS. 14A and 14B are cross-sectional views showing the details of the back supporting roller shown in FIG. 13.

As shown in FIG. 14A, each of the back supporting rollers 72 includes a rotation shaft 74 and a pair of rolling components 75 fixed to the rotation shaft 74. The rotation shaft 74 of the back supporting roller 72 is supported freely in rotating to the roller housing 73 through bearings 76. A space between the rolling components 75 is set equivalent to the space between the links 5*b* located on both sides of the pin roller 5*a* in the chain 5, so that the rolling components 75 can roll without interference with the pin roller 5*a* with the upper edge of the links 5*b* used as rolling surfaces. A rolling surface 75*a*, i.e., the outer circumferential surface of the rolling component 75, which rolls on the link 5*b*, is coated with a material such as plastic capable of highly absorbing vibration and noise, rubber or the like. The rolling component 75 is made of damping steel, which has sufficient rigidity and excellent absorptivity of vibration and noise.

Figure 14B:
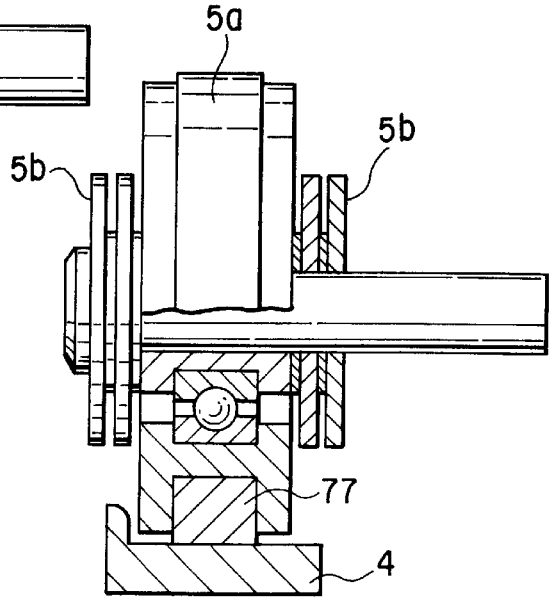

In regard to the pin roller 5*a* of the chain 5, as shown in FIG. 14B, to the outer circumferential portion that rolls on the footstep guide rail 4, there is mounted a cushion ring 77 formed from a material such as ring-shaped soft plastic. The pin roller 5*a* rolls on the footstep guide rail 4 through the cushion ring 77. In this case, the width of the cushion ring 77 is narrower than the width of the pin roller 5*a*. The outer circumferential surfaces of the pin roller 5*a* on both sides of the cushion ring 77 are formed so as to supply a thrust while rolling on the trochoid shaped gear of the pin roller rolling gear teeth 11. Therefore, the body of pin roller 5*a* employs steel with high rigidity so as not to deform, which is different from the material of the cushion ring 77.

The pin roller rolling gear teeth 11 require the sufficient rigidity in the same manner as the pin roller 5*a*. However, the pin roller rolling gear teeth 11 employ damping steel that is sufficiently rigid and further effective in absorbing vibration, so as to absorb vibration and noise which are generated when the pin roller rolling gear supplies thrust to the pin roller 5*a*, as much as possible.

Next, the action of the driving mechanism 70 in the passenger conveyer system according to the sixth embodiment will be described.

In FIG. 13, while rocking, the pin roller rolling gear teeth 11 mesh with the pin rollers 5*a* of the chain 5, thereby supplying a thrust to the chain 5. During this process, the back supporting rollers 72 support the chain 5 from the side opposite to the pin roller rolling gears 11 while rolling on the links 5*b* of the chain 5. More specifically, assume that the force acting on the chain 5 from the pin roller rolling gear teeth 11 is denoted with F. While rolling on the links 5*b* of the chain 5, the back supporting rollers 72, which are held in the roller housing 73, are applied with the vertical drag N that is the element of the force F in a direction perpendicular to the direction which the chain 5 proceeds in. Then the back supporting rollers 72 press the chain 5 to the pin roller rolling gear teeth 11 by the reaction force N' against the vertical drag N.

Therefore, it is possible to prevent a slip from occurring between the meshing pin rollers 5*a* and the gear of the trochoid tooth form in the pin roller rolling gear teeth 11. As a result, losses of mechanical work can be reduced. In addition to that, it is possible to maintain the mechanical principles in that the pin rollers 5*a* steadily capture the thrust supplied from the pin roller rolling gear teeth 11, and the pin roller rolling gears having the trochoid shaped gears contribute uniform motion to the pin rollers 5*a*.

In addition, according to the embodiment, the interval δ in the arrangement of the plural back supporting rollers 72, which are held in the roller housing 73, are shorter than the pitch length P of the link 5*b* in the chain 5. Therefore, moments around the back supporting rollers 72, which are generated by the vertical drag N, do not increase. Accordingly, the reaction force N' to support back-up the pin rollers 5*a*, which are located at the front and the rear of the back supporting roller 72 does not increase in comparison with the vertical drag N. As a result, there is no need of countermeasure such as strengthening the footstep guide rail 4.

Further, the rolling surface of the rolling component 75 in the back supporting roller 72 is coated with plastic or the like. Therefore, an intermittent impact to be applied to the rolling component 75 by the vertical drag N is absorbed effectively. Furthermore, since the cushion ring 77 is mounted on the pin roller 5*a*, an impact transmitted from the footstep guide rail 4 is relieved through the cushion ring 77, thereby suppressing the generation of vibration and noise.

Next, the passenger conveyer system according to the seventh embodiment of the invention will be described with reference to FIGS. 15 and 16.

The seventh embodiment is different from the sixth embodiment in the point that the endless circular back supporting means is provided instead of the back supporting rollers 72.

Figure 15:
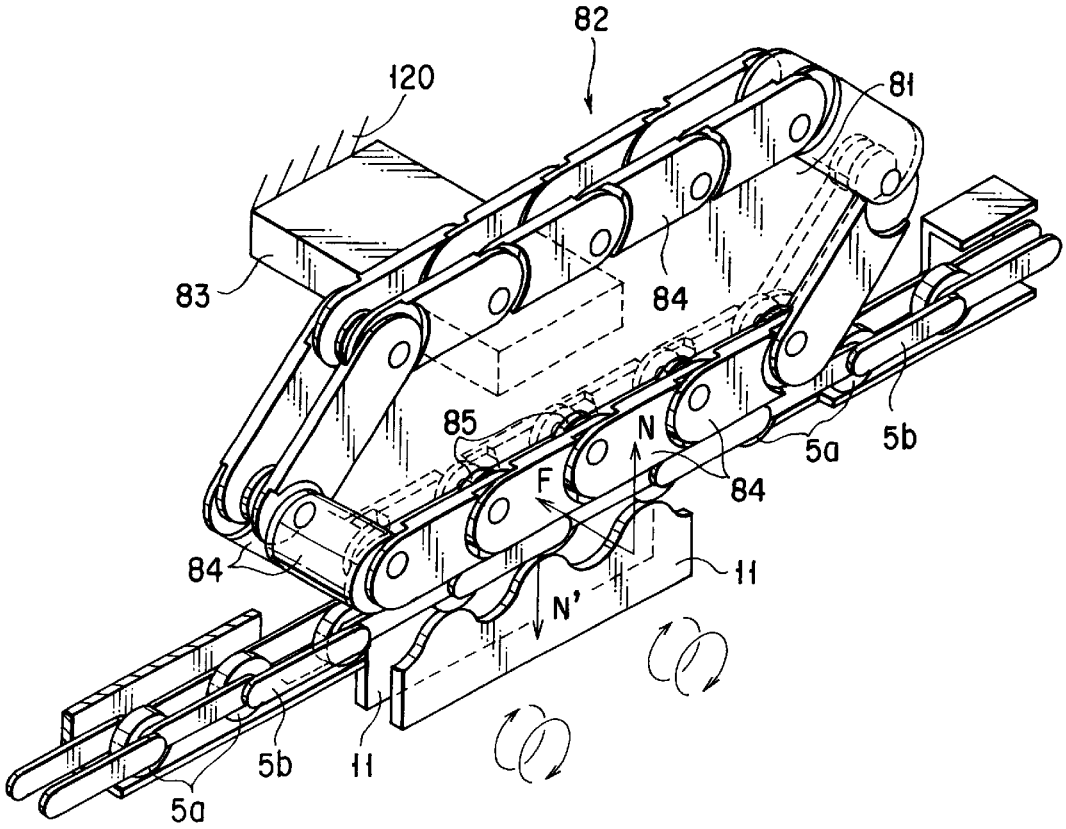
FIG. 15 is a perspective view showing a back supporting circular wire rope component which backs and supports a chain in a passenger conveyer system according to the seventh embodiment of the invention.
Figure 16:
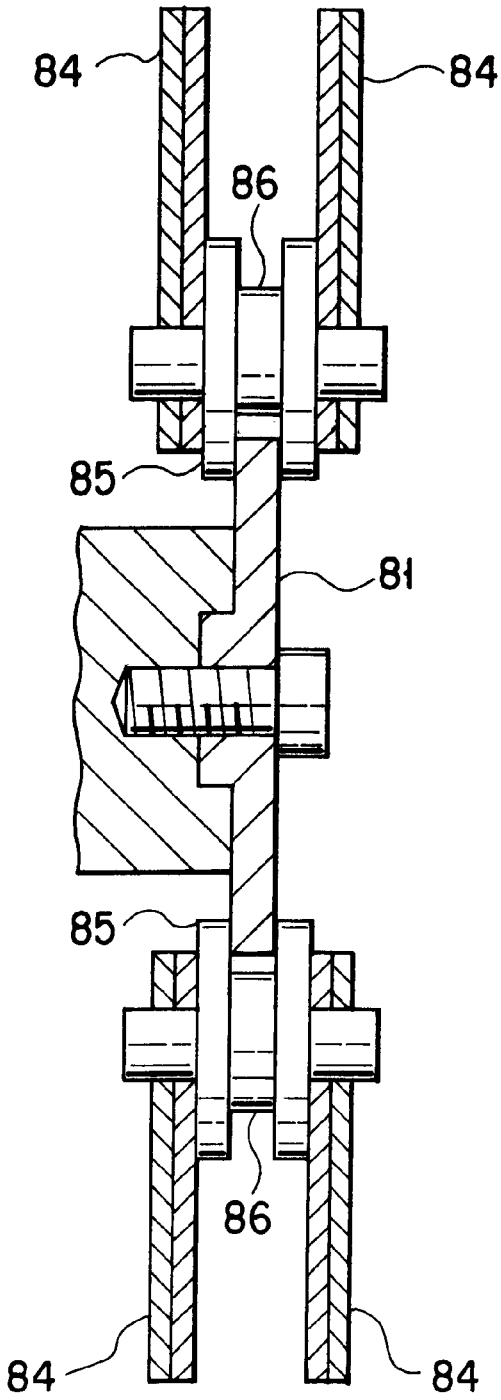
FIG. 16 is a cross-sectional view of the back supporting circular wire rope component shown in FIG. 15.

FIG. 15 is a view showing non-end circular back supporting means that back up and support the chain 5 from the side reverse to the pin roller rolling gear teeth 11 in a driving mechanism of the passenger conveyer system 80. Incidentally, in FIG. 15, the identical constituting components to FIG. 13 are marked with the identical reference symbols, and detailed descriptions will be omitted.

The back supporting means includes an elliptical back supporting guide 81 and a back supporting wire rope component 82, which is connected along the outer circumferential portion of the elliptical back supporting guide 81 in the endless circular form.

The back supporting guide 81 is fixed to a supporting member 83, which is extended from the structure 120, in the form parallel to the chain 5. The back supporting wire rope component 82 is formed by contentiously connecting through guide rollers 85 in the endless circular form with a wire rope section 84 being as a unit. The guide rollers 85 are mounted freely in rotation and engage the outer circumferential portion of the back supporting guide 81 with a circumferential groove 86 while rolling. In the back supporting wire rope component 82, a series of wire rope sections located on the lower side are in contact with the links 5*b* of the chain 5 from the side reverse to the pin roller rolling gear teeth 11.

Therefore, while moving circularly in accordance with the movement of the chain 5, the back supporting wire rope component 82 supports the chain 5 steadily. That is, the wire rope sections 84 are affected by the vertical drag N as a directional element perpendicular to the traveling direction of the chain 5 out of the force F which the pin rollers 5*a* of the chain 5 is applied from the pin roller rolling gear teeth 11. Then, the guide rollers 85, which are held in the wire rope sections 84, receive the vertical drag N' while rolling and then press the wire rope sections 84 against the chain 5 with the drag N'. Therefore, it is possible to prevent a slip from occurring between the meshing pin rollers 5*a* and the gear of the trochoid tooth form in the pin roller rolling gear teeth 11. As a result, losses of mechanical work, which are caused by frictional force or heat generation, can be reduced.

Incidentally, it is preferable to use a damping steel product that has sufficient rigidity and absorptivity of vibration and noise for the material of the wire rope section 84 in the back supporting wire rope component 82 in order to relieve an impact caused by the intermittent vertical drag, which is applied from the pin roller rolling gear teeth 11 through the chain 5. In addition, it is preferable that a portion of the wire rope section 84, which comes into contact with the link 5*b* of the chain 5, is coated with thin film made of plastic absorbing vibration and noise, or the like.

INDUSTRIAL APPLICABILITY

As described above, according to the invention, without using specific constituting components such as a toothed chain or the like, sufficient driving force can be applied in the middle section of a circulating chain with use of an inexpensive and standard chain. Thus it is possible to provide a passenger conveyer system suitable for an escalator of high steps, a moving walkway for long moving distance, or the like.

What is claimed is:

1. A passenger conveyer system, comprising:

a footstep guide rail provided in a structure;

a plurality of footsteps which move along the footstep guide rail;

a chain which connects the plurality of footsteps with one another in an endless circular manner; and a trochoid mechanism having a rocking unit, the mechanism including pin rollers which relatively drive linearly in accordance with the rock of the rocking unit and a trochoid tooth-shaped section which meshes with the pin rollers and which are disposed between the chain and the rocking unit.

2. The system according to claim 1, wherein the pin rollers are provided in the chain, and the trochoid tooth-shaped section is provided in the rocking unit.

3. The system according to claim 1, wherein the pin rollers are provided in the rocking unit, and the trochoid tooth-shaped section is provided in the chain.

4. The system according to claim 1, wherein a plurality of trochoid mechanisms is provided along a circular direction of the chain.

5. The system according to claim 1, wherein the trochoid mechanism comprises:

a rotary driving device;

an eccentric crankshaft which is connected to the rotary driving device and rotates eccentrically;

the rocking unit which is connected to the eccentric crankshaft and rocks in accordance with the eccentric rotation of the eccentric crankshaft;

pin rollers which are provided to mutually mesh with the rocking unit and the chain, and apply a thrust to the chain in accordance with the rock of the rocking unit; and trochoid rolling gear teeth as the trochoid tooth-shaped section.

6. The system according to claim 1, wherein a plurality of the rocking units is combined through an idler eccentric crankshaft and disposed separately in the front and the rear in a circular direction of the chain.

7. The system according to claim 1, wherein the rocking unit, in which pin roller rolling gear teeth include the trochoid tooth-shaped section configured to mesh with the pin rollers and in which the pin roller rolling gear teeth are fixed on both the approach route side and the return route side in the chain which circularly goes up and down, gives a thrust to the pin rollers of the chain on both the approach route side and the return route side.

8. The system according to claim 1, further comprising:

a sprocket which meshes with a turning reverse section for the chain; and a driving section having a driving motor which drives the sprocket.

9. The system according to claim 1, further comprising back supporting means for supporting a back of the chain.

10. The system according to claim 9, wherein the back supporting means is a back supporting roller mechanism including a roller which rolls on a link provided in the chain, and backs up and supports the chain from the side opposite to the trochoid tooth-shaped section.

11. The system according to claim 9, wherein the back support means includes a guide which is supported on the structure side and wire rope sections which connect to one another in an endless circular manner along a circumference of the guide, and includes means for supporting the chain while moving circularly in accordance with a movement of the chain.

12. The system according to claim 1, further comprising a back support configured to support the back of the chain.

13. The system according to claim 12, wherein the back support includes a back supporting roller mechanism including a roller which rolls on a link provided in the chain, and backs up and supports the chain from the side opposite to the trochoid tooth-shaped section.

14. The system according to claim 12, wherein the back support includes a guide which is supported on the structure side and wire rope sections which connect to one another in an endless circular manner along the circumference of the guide, and includes a chain support which supports the chain while moving circularly in accordance with the movement of the chain.

15. A passenger conveyer system, comprising:

a footstep guide rail provided for a structure;

a plurality of footsteps which move along the footstep guide rail;

a chain which connects with the plurality of footsteps in an endless circular manner;

a rotary driving device fixed to the structure; and driving means for converting rotary motion transmitted through an eccentric shaft from the rotary driving device into rocking movement of a rocking unit and applying a thrust from the rocking unit through a trochoid tooth-shaped section which meshes with pin rollers, some provided in the rocking unit and others provided in the chain, and for providing a plurality of the rocking units so as to apply a thrust to the chains connected on both sides in a width direction of the footsteps, thereby driving the plurality of the rocking units through the eccentric shaft from the rotary driving device.

16. A passenger conveyer system, comprising:

a footstep guide rail provided for a structure;

a plurality of footsteps which move along the footstep guide rail;

a chain which connects with the plurality of footsteps in an endless circular manner;

a rotary driving device fixed to the structure; and a driver configured to convert rotary motion transmitted through an eccentric shaft from the rotary driving device into rocking movement of a rocker, to apply a thrust from the rocker through a trochoid tooth-shaped section which meshes with pin rollers, some provided in the rocker and the others provided in the chain, and to provide a plurality of the rockers so as to apply a thrust to the chains connected on both sides in a width direction of the footsteps, thereby driving the plurality of the rockers through the eccentric shaft from the rotary driving device.

* * * * *